US008388557B2

(12) United States Patent
Moomiaie-Qajar et al.

(10) Patent No.: US 8,388,557 B2
(45) Date of Patent: Mar. 5, 2013

(54) PORTABLE COMPRESSION DEVICE

(76) Inventors: Remo Moomiaie-Qajar, Huntington Station, NY (US); Jonathan L. Pearlman, Pittsburgh, PA (US)

( * ) Notice: Subject to any disclaimer, the term of this patent is extended or adjusted under 35 U.S.C. 154(b) by 1260 days.

(21) Appl. No.: 12/143,371

(22) Filed: Jun. 20, 2008

(65) Prior Publication Data

US 2008/0319359 A1 Dec. 25, 2008

Related U.S. Application Data

(60) Provisional application No. 60/936,420, filed on Jun. 20, 2007.

(51) Int. Cl.
*A61H 1/00* (2006.01)
*A61H 11/00* (2006.01)
*A61H 19/00* (2006.01)

(52) U.S. Cl. ..... 601/1; 601/143; 601/144; 601/147; 128/882

(58) Field of Classification Search ..... 601/41, 601/43, 84, 133, 134, 148, 149, 150, 151, 601/152; 128/878–879, 882
See application file for complete search history.

(56) References Cited

U.S. PATENT DOCUMENTS

| | | | | |
|---|---|---|---|---|
| 443,204 | A | 12/1890 | Davis | |
| 718,766 | A | 1/1903 | Ingram | |
| 2,118,699 | A | 5/1938 | Chappell | |
| 3,853,121 | A | 12/1974 | Mizrachy et al. | |
| 4,013,069 | A | 3/1977 | Hasty | |
| 4,030,488 | A | 6/1977 | Hasty | |
| 4,198,961 | A | 4/1980 | Arkans | |
| 4,202,325 | A | 5/1980 | Villari et al. | |
| 4,206,751 | A | 6/1980 | Schneider | |
| 4,206,765 | A * | 6/1980 | Huber | 600/490 |
| 4,207,875 | A | 6/1980 | Arkans | |

(Continued)

FOREIGN PATENT DOCUMENTS

| | | |
|---|---|---|
| CH | 187 824 | 11/1936 |
| KR | 10-2007-0007085 A | 1/2007 |

(Continued)

OTHER PUBLICATIONS

Adair et al., "Growth regulation of the vascular system: evidence for metabolic hypothesis," *Am J Physiol Regulatory Integrative Comp Physiol*, vol. 259, pp. 393-404 (1990).

(Continued)

*Primary Examiner* — Patricia Bianco
*Assistant Examiner* — George N Phillips
(74) *Attorney, Agent, or Firm* — Eckert Seamans Cherin & Mellott, LLC; Stephen A. Bucchianeri

(57) ABSTRACT

A portable compression device for compressing at least a portion of a mammal's limb is provided. The portable compression device can use mechanical compression to apply an external pressure to the portion of the limb to thereby propagate blood flow return in the direction of the mammal's heart. In at least one embodiment, the portable compression device can accomplish this mechanical compression through the use of at least one frame, actuator, drum, and flexible elongate member. The actuator can move the drum between a first position and a second position. The flexible elongate member can be engaged with at least a portion of the drum and can at least partially circumscribe a portion of the limb of the mammal, such that the movement of the drum between the first and second positions can apply tension to the flexible elongate member to thereby apply a compressive force to the limb.

11 Claims, 18 Drawing Sheets

U.S. PATENT DOCUMENTS

| | | | | |
|---|---|---|---|---|
| 4,207,876 | A | 6/1980 | Annis | |
| 4,253,449 | A | 3/1981 | Arkans et al. | |
| 4,320,746 | A | 3/1982 | Arkans et al. | |
| 4,375,217 | A | 3/1983 | Arkans | |
| 4,396,010 | A | 8/1983 | Arkans | |
| 4,402,312 | A | 9/1983 | Villari et al. | |
| 4,732,140 | A | 3/1988 | Stoffregen | |
| 4,738,249 | A | 4/1988 | Linman et al. | |
| 4,793,328 | A | 12/1988 | Kolstedt et al. | |
| 4,858,596 | A | 8/1989 | Kolstedt et al. | |
| 4,865,020 | A | 9/1989 | Bullard | |
| 4,928,674 | A | 5/1990 | Haperin et al. | |
| 4,966,396 | A | 10/1990 | Dye | |
| 5,009,222 | A | 4/1991 | Her | |
| 5,022,387 | A | 6/1991 | Hasty | |
| 5,027,797 | A | 7/1991 | Bullard | |
| 5,117,812 | A | 6/1992 | McWhorter | |
| 5,263,473 | A | 11/1993 | McWhorter | |
| 5,334,131 | A | 8/1994 | Omandam et al. | |
| 5,407,418 | A | 4/1995 | Szpur | |
| 5,496,262 | A | 3/1996 | Johnson, Jr. et al. | |
| 5,569,297 | A | 10/1996 | Makower et al. | |
| 5,571,075 | A | 11/1996 | Bullard | |
| 5,575,761 | A | 11/1996 | Hajianpour | |
| 5,588,954 | A | 12/1996 | Ribando et al. | |
| 5,591,200 | A | 1/1997 | Cone et al. | |
| 5,769,801 | A | 6/1998 | Tumey et al. | |
| 5,830,164 | A | 11/1998 | Cone et al. | |
| 5,951,502 | A | 9/1999 | Peeler et al. | |
| 5,997,465 | A | 12/1999 | Savage et al. | |
| 6,010,470 | A | 1/2000 | Albery et al. | |
| 6,029,294 | A | 2/2000 | Saringer | |
| 6,135,116 | A | 10/2000 | Vogel et al. | |
| 6,152,893 | A | 11/2000 | Pigg et al. | |
| 6,174,295 | B1 | 1/2001 | Cantrell et al. | |
| 6,231,280 | B1 | 5/2001 | Bullen | |
| 6,231,532 | B1 | 5/2001 | Watson et al. | |
| 6,269,500 | B1 | 8/2001 | Saringer | |
| 6,290,662 | B1 | 9/2001 | Morris et al. | |
| 6,296,617 | B1 | 10/2001 | Peeler et al. | |
| 6,440,093 | B1 | 8/2002 | McEwan et al. | |
| 6,447,467 | B1 | 9/2002 | Barak | |
| 6,468,237 | B1 | 10/2002 | Lina | |
| 6,478,757 | B1 | 11/2002 | Barak | |
| 6,494,852 | B1 | 12/2002 | Barak et al. | |
| 6,551,280 | B1 | 4/2003 | Knighton et al. | |
| 6,589,194 | B1 | 7/2003 | Calderon et al. | |
| 6,616,620 | B2 | 9/2003 | Sherman et al. | |
| 6,689,076 | B2 | 2/2004 | Saringer | |
| 6,806,573 | B2 | 10/2004 | Hu | |
| 6,905,456 | B1 | 6/2005 | Brunner et al. | |
| 6,945,944 | B2 | 9/2005 | Kuiper et al. | |
| 7,063,676 | B2 | 6/2006 | Barak et al. | |
| 7,354,410 | B2 | 4/2008 | Perry et al. | |
| 7,534,215 | B2 | 5/2009 | Saringer | |
| 7,591,796 | B1 | 9/2009 | Barak et al. | |
| 7,618,384 | B2 * | 11/2009 | Nardi et al. | 601/149 |
| 7,637,879 | B2 | 12/2009 | Barak et al. | |
| D610,263 | S | 2/2010 | Dagan et al. | |
| 2002/0026131 | A1 | 2/2002 | Halperin | |
| 2002/0169399 | A1 | 11/2002 | Rastegar et al. | |
| 2004/0073146 | A1 | 4/2004 | Weintraub et al. | |
| 2005/0107725 | A1 | 5/2005 | Wild et al. | |
| 2006/0074362 | A1 * | 4/2006 | Rousso et al. | 601/152 |
| 2006/0079824 | A1 | 4/2006 | Munch-Fals et al. | |
| 2006/0122546 | A1 | 6/2006 | Rousso | |
| 2006/0135894 | A1 | 6/2006 | Linnane et al. | |
| 2007/0038167 | A1 | 2/2007 | Tabron et al. | |
| 2007/0049852 | A1 | 3/2007 | Linnane et al. | |
| 2007/0049853 | A1 | 3/2007 | Adams et al. | |
| 2007/0055188 | A1 | 3/2007 | Avni et al. | |
| 2007/0173886 | A1 | 7/2007 | Rousso et al. | |
| 2007/0249976 | A1 | 10/2007 | Tucker et al. | |
| 2007/0249977 | A1 | 10/2007 | Bonnefin et al. | |
| 2008/0004548 | A1 | 1/2008 | Oshmyansky | |
| 2008/0015630 | A1 | 1/2008 | Rousso | |
| 2008/0039752 | A1 | 2/2008 | Rousso | |
| 2008/0071204 | A1 | 3/2008 | Linnane et al. | |
| 2008/0097268 | A1 | 4/2008 | Rousso | |
| 2008/0255494 | A1 | 10/2008 | Rousso et al. | |
| 2008/0269543 | A1 | 10/2008 | Rousso | |
| 2009/0118651 | A1 | 5/2009 | Rousso et al. | |
| 2010/0010404 | A1 | 1/2010 | Nardi et al. | |
| 2010/0010405 | A1 | 1/2010 | Nardi et al. | |
| 2010/0010406 | A1 | 1/2010 | Nardi et al. | |

FOREIGN PATENT DOCUMENTS

| | | | |
|---|---|---|---|
| KR | 1020070027506 | A | 3/2007 |
| WO | WO 97/04820 | | 2/1997 |
| WO | WO 00/28334 | | 5/2000 |
| WO | WO 01/32124 | | 5/2001 |
| WO | WO 2004/093763 | | 11/2004 |
| WO | WO 2005/051250 | | 6/2005 |
| WO | WO 2005/072674 | | 8/2005 |
| WO | WO 2005/074376 | | 8/2005 |
| WO | WO 2005/120424 | | 12/2005 |
| WO | WO 2006/040109 | | 4/2006 |
| WO | 2007/033401 | A1 | 3/2007 |
| WO | WO 2007/079777 | | 7/2007 |

OTHER PUBLICATIONS

Allan, et al., The use of graduated compression stockings in the prevention of postoperative deep vein thrombosis, *Br. J. Surg*., vol. 70, pp. 172-174 (1983).

Badr, et al., "Differences in local environment determine the site of physiological angiogenesis in rat skeletal muscle," *Exp Physiol* (*ep. physoc.org*), pp. 565-568 (2003).

Butson, A. Richard C., "Intermittent Pneumatic Calf Compression for Prevention of Deep Venous Thrombosis in General Abdominal Surgery," *Am J Surg*, vol. 142, pp. 525-527 (1981).

Byl et al., "Low-Dose Ultrasound Effects on Would Healing: A Controlled Study With Yucatan Pigs," *Arch Phys Med Rehabil*, vol. 73, pp. 656-664 (1992).

Clagett, G. Patrick and Joan S. Reisch, "Prevention of Venous Thromboembolism in General Surgical Patients," *Ann Surg*, vol. 208, pp. 227-240 (1988).

Comerota et al., "The Fibrinolytic Effects of Intermittent Pneumatic Compression: Mechanism of Enhanced Fibrinolysis," *Ann Surg*, vol. 226, pp. 306-313 (1997).

Dawson et al., "A Comparison of the Microcirculation in Rat Fast Glycolytic and Slow Oxidative Muscles at Rest and during Contractions," *Microvascular Research*, vol. 33, pp. 167-1812 (1987).

Deveci et al., "Relationship between capillary angiogenesis, fiber type, and fiber size in chronic systemic hypoxia," *Am J. Physiol Heart Circ Physiol*, vol. 281, pp. H241-H585 (2001).

Dyson, Mary and Douglas A. Luke, "Induction of Mast Cell Degranulation in Skin by Ultrasound," *IEEE Transactions on Ultrasonics, Fenoelectrics, and Frequency Control*, vol. UFFC-33, No. 2, pp. 194-201 (1986).

Dyson, Mary and J. Suckling, "Stimulation of Tissue Repair by Ultrasound: A Survey of the Mechanisms Involved," *Physiotherapy*, vol. 64, pp. 105-108 (1978).

Egginton et al., "Capillary growth in relation to blood flow and performance in overloaded rat skeletal muscle," *J Appl Physiol*, vol. 85, pp. 2025-2032 (1998).

Heit, John A., "Venous Thromboembolism Epidemiology: Implications for Prevention and Management," *Seminars in Thrombosis and Hemostasis*, vol. 28, Supplement 2, pp. 3-13 (2002).

Hills et al., "Prevention of Deep Vein Thrombosis by Intermittent Pneumatic Compression of Calf," *British Medical Journal*, pp. 131-135 (1972).

Hudlicka O., "Is Physiological Angiogenesis in Skeletal Muscle Regulated by Changes in Microcirculation?" *Microcirculation*, vol. 5, pp. 5, 7-23, (1998).

Hudlicka et al., "Early changes in fiber profile and capillary density in long-term stimulated muscles," pp. H528-H535 (1982).

Milkiewicz et al., Association between Shear Stress, Angiogenesis, and VEGF in Skeletal Muscles In Vivo, *Microemulsion*, vol. 8, pp. 229-241 (2001).

Moser et al., "Mechanical Versus Pharmacologic Prevention of Deep Venous Thrombosis," *Surgery, Gynecology & Obstetrics*, vol. 152, pp. 448-450 (1981).
Mühe, Erich, "Intermittent Sequential High-Pressure Compression of the Leg: A New Method of Preventing Deep Vein Thrombosis," *Am J Surg*, vol. 147, pp. 781-785 (1984).
Nicolaides et al., "Intermittent sequential pneumatic compression of the legs and thromboembolism-deterrent stockings in the prevention of postoperative deep venous thrombosis," *Surgery*, vol. 94, pp. 21-25 (1983).
Pilla et al., "Non-Invasive Low-Intensity Pulsed Ultrasound Accelerates Bone Healing in the Rabbit," *Journal of Orthopaedic Trauma*, vol. 4, No. 3, pp. 246-253 (1990).
Prentice, William E., *Therapeutic Modalities in Sports Medicine*, Third Edition, Mosby-Year Book, Inc. (1994).
Turner et al., "The efficacy of graduated compression stockings in the prevention of deep vein thrombosis after major gynaecological surgery," *British Journal of Obstetrics and Gynaecology*, vol. 91, pp. 588-591 (1984).
Webster, DF, "The Effect of Ultrasound on Wound Healing," Ph.D. Thesis. University of London. (copy not permitted, but publicly accessible at the University of London).
Webster et al., "The role of ultrasound-induced cavitation in the 'in vitro' stimulation of collagen synthesis in human fibroblasts," *Ultrasonics*, pp. 33-37 (1980).
Wells et al., "Graduated Compression Stockings in the Prevention of Postoperative Venous Thromboembolism: A Meta-analysis," *Arch Intern Med*, vol. 154, pp. 67-72 (1994).
Wells, P., "Ultrasonics in Medicine and Biology," *Phys. Med. Biol.*, vol. 22, No. 4, pp. 629-669 (1977).
Wells, P., *Biomedical Ultrasonics*, Academic Press (1977).
http://www.mcsmed.com.
http://www.ctu676.com.
http://www.michmedical.com.
European Patent Office, "Extended European Search Report", Sep. 3, 2012, 7 pp.

* cited by examiner 116
130
114
118

116
130
118
114

132
116
114

116
130
114
130
118

110
116
132
118
130
118
114

116
114
110

338
314

316
318
338
314
320''
320'
320

316
320''
320'
320
314
312
338

338
314
318
320'

320''
320'
320
312
316
314
338
318
314

310

449
414
448
451
452
453
410

449
451
414
450
453
450
410

448
450
453
452

414
448
453

414
451
448
450
450

734
716
714
721
734
718

720
714
721
716

734
716
721
718
734
714

720
734
716
718
723
721
714
725
734
710

814
848
849
850
851
852
853
810

1035'
1014
1017

1019
1019'
1035
1031
1033
1023
1029
1023'
1033'
1031
1021
1039
1041
1035
1043

1035'
1045
1035
1019
1023
1031
1029
1025
1027
1017
1016
1025'
1023'
1019
1037
1031'
1010

1016
1041
1017
1039
1019'
1035
1049
1023
1025
1027
1037
1019
1035'

1049
1023'

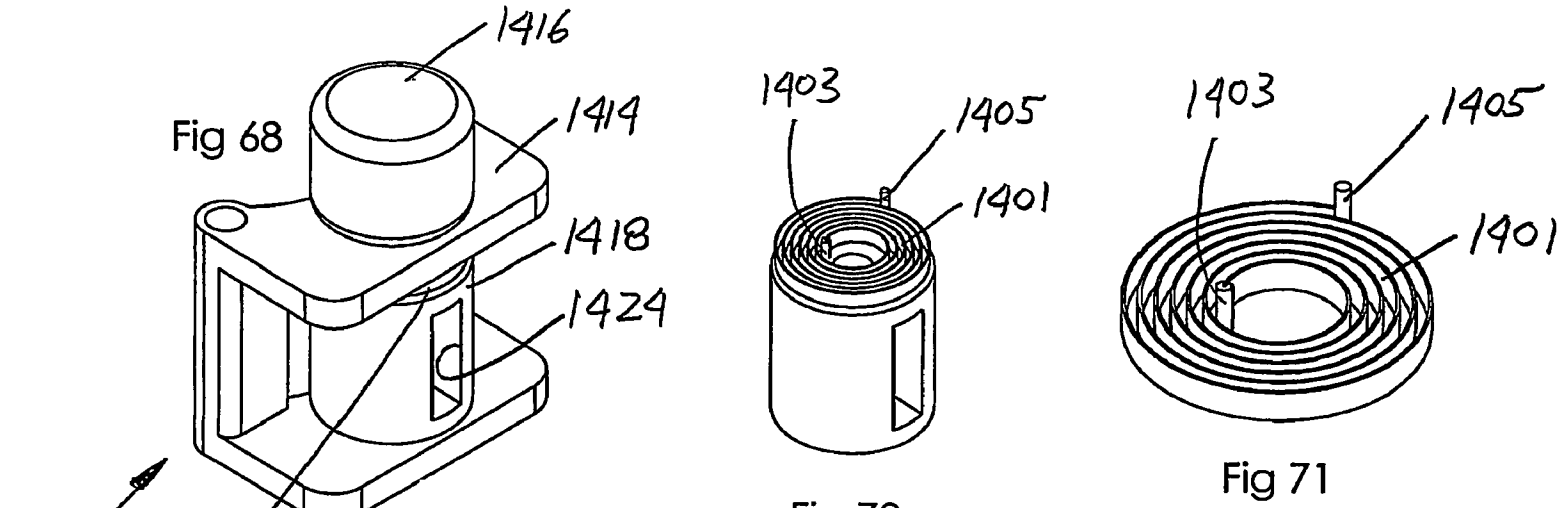
Fig 71
Fig 70
Fig 68
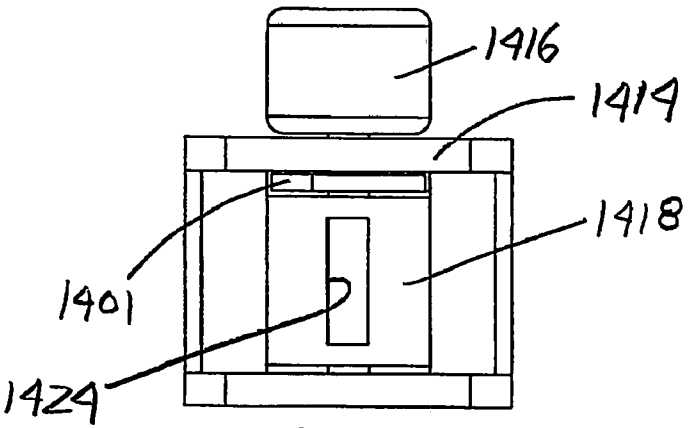
Fig 69

PORTABLE COMPRESSION DEVICE

CROSS REFERENCE TO RELATED APPLICATIONS

The present application claims priority under 35 U.S.C. §119(e) from U.S. Provisional Patent Application Ser. No. 60/936,420, filed on Jun. 20, 2007, entitled PORTABLE COMPRESSION DEVICE, the entire disclosure of which is hereby incorporated by reference herein.

FIELD OF THE INVENTION

The present invention generally relates to a compression device and, more particularly, relates to a portable compression device for non-pharmaceutical modalities.

BACKGROUND OF THE INVENTION

Venous insufficiency is a term used to describe a functional failure of venous valves in a venous system. This functional failure can occur when venous veins distend and the venous valves become incompetent because the outermost edges of the venous veins do not approximate and close as a pair. In general, the venous valves may be prone to failure due to numerous conditions and co-morbidities. Unfortunately, venous insufficiency is often undiagnosed until late clinical manifestations because of its difficulty to detect.

Deep vein thrombosis and pulmonary embolism (hereafter collectively termed "venous thromboembolism"), a progression of venous insufficiency, are significant medical conditions that have high morbidity and mortality. For example, research has estimated that over 200,000 new cases of venous thromboembolism occur annually. Further, venous thromboembolism can occur as a culmination of a series of pathophysiologic events that can manifest in patients of all ages with high risk factors. Some of these high risk factors can include, but are not limited to, any of the following conditions in a patient: antithrombin deficiency, proteins C & S deficiencies, factor V leiden, prothrombin mutation, age greater than 40 years, malignancy, antiphospholipid antibodies, history of venous thromboembolism, prolonged immobilization, "economy class syndrome," bed rest, pregnancy, oral contraceptives/hormone replacement therapy, ischemic (non-hemorrhagic) stroke, pneumonia and respiratory failure, chronic inflammatory disorder and/or active collagen vascular disorder.

In brief, the pathophysiology of venous thromboembolism is based on pooling of venous blood that forms clots (deep vein thrombosis). These clots lodge within the veins, particularly within deep veins of a patient's extremities, but can also form at other locations in a patient's body. As the length of time of venous stasis increases, i.e., the length of time when blood "pools" or is not propagated under normal physiologic parameters, the elastic veins distend and further render the venous valves incompetent, leading to more pooling and coagulation of blood, also known as clot formation. After clot formation, the clot can then fragment or dislodge from the veins and propagate to a heart of the patient, and then to the clot's final destination, the patient's lung, thereby forming a pulmonary embolism (hereafter "PE").

The PE physically blocks the gas exchange function of the lung and, if the clot is large enough, the PE can be instantly fatal to the patient. Approximately 70% of patients with fatal PEs are diagnosed only at an autopsy because the PE diagnosis is not usually suspected clinically by doctors. The majority of patients with medium to large PEs die within thirty minutes after the onset of symptoms, thereby preventing timely administration of thrombolytic therapy or surgical intervention. Improved methods of deep vein thrombosis prevention are therefore needed to lower mortality associated with PE.

Current prophylactic treatments for venous thromboembolism can include two treatment options: pharmaceutical and non-pharmaceutical modalities. The pharmaceutical modalities can include anticoagulation therapy, such as the administration of heparin or low molecular weight heparin, warfarin (Coumadin™), etc., which therapies may sometimes have significant bleeding risk because of the reduced viscosity in the patient's blood associated therewith. Thus, these pharmaceutical modalities must be used in a controlled setting. Often pharmaceutical modalities can require that the patient be in a hospital or an outpatient care facility during use and require routine blood monitoring and adjustment in dose for proper anticoagulation. Non-pharmaceutical modalities can include compression hosieries and various pneumatic sequential compression devices (hereafter "SCD" or "SCDs") and constitute one of the most functional and, likely the least invasive, form of prophylaxis.

Pneumatic SCDs have been used mostly for incompetent vascular circulation of the patient's lower extremities. To date, most therapeutic uses of SCDs occur within an inpatient care setting and use cumbersome pneumatic pumps. These pneumatic SCDs provide for external compression of the lower extremities to mimic a physiologic pumping action of the patient's leg musculature for venous return of blood to the heart and for perpetuating systemic anticoagulant factor release from endothelial cells.

The pneumatic SCDs typically consist of three separate components that must be connected together in order for the SCD to function properly. These components are generally: (1) large, plug-in, motor units, (2) tubing, and (3) compression sleeves or stockings that are typically attached to the lower extremities of the patient. Once the three components are attached and functioning, the pneumatic SCD can render the patient immobile, or virtually immobile, because of the trip and fall hazard associated with ambulating with an anchored motor unit and/or the tubing that attaches all three components. The pneumatic SCD's components only work as a unit when all three components are attached to each other and when the unit is plugged into an electricity source. Thus, when a patient disconnects the sleeve or stocking from the tubing in order to ambulate, the pneumatic SCD is no longer functional.

Inherent problems with all pneumatic SCDs are their size, weight, immobility, and disruptive noise level. Further, most pneumatic SCDs offer only a cuff or sleeve, which is worn on the limb or extremity of a patient, and can restrict the patient's functional motion. Most available pneumatic SCDs do not have battery options, and those that do can be quite cumbersome and make mobile operation nearly impossible for the patient. What is needed is an improvement over the foregoing.

SUMMARY OF THE INVENTION

In one form of the invention, a portable compression device configured to compress at least a portion of a mammal's limb is provided. In at least one embodiment, the portable compression device can be non-pneumatic and can use mechanical compression to apply an external pressure to the portion of the limb to thereby propagate blood flow return in the direction of the mammal's heart. In various embodiments, the portable compression device can accomplish this mechanical compression through the use of at least one frame, actuator, drum, and flexible elongate member. In at least one embodiment, the actuator can be operatively engaged with the drum, such that actuator can move and/or rotate the drum at least between a first position and a second position. In at least one embodiment, the flexible elongate member can be engaged with at least a portion of the drum and can at least partially circumscribe a portion of the limb of the mammal, such that the movement of the drum between the first and second positions can apply tension to the flexible elongate member and thereby apply a compressive force to the portion of the limb. In at least one embodiment, the actuator, drum, and flexible elongate member of the portable compression device may be situated on and/or engaged with the frame, for example.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein:

FIG. 68 is a perspective view of a portable compression device including a torsion spring element in accordance with one non-limiting embodiment of the present invention;

FIG. 69 is an elevation view of the portable compression device of FIG. 68;

FIG. 70 is a perspective view of the drum and torsion spring element of FIG. 68; and FIG. 71 is a perspective view of the torsion spring element of FIG. 68.

Figure 3:
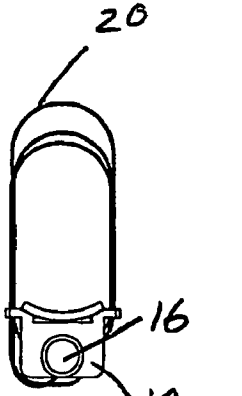
FIG. 3 is a top view of the portable compression device of FIG. 1.
Figure 4:
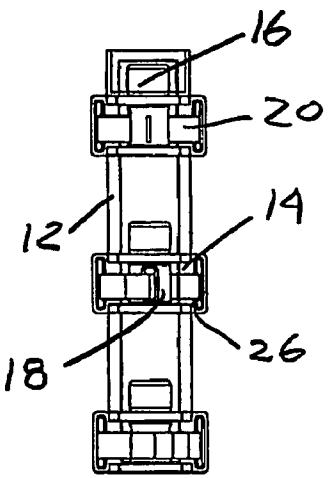
FIG. 4 is an elevation view of the portable compression device of FIG. 1.
Figure 2:
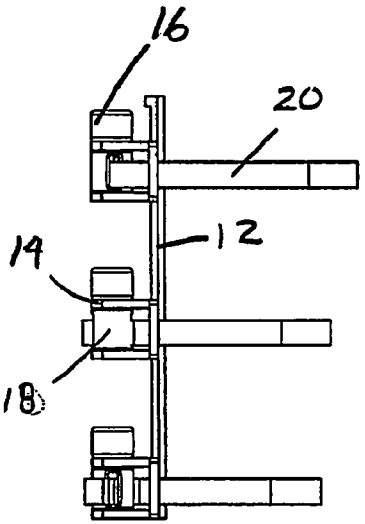
FIG. 2 is a side view of the portable compression device of FIG. 1.

Corresponding reference characters indicate corresponding parts throughout the several views. The exemplary embodiments set out herein illustrate preferred embodiments of the invention, in one form, and such exemplary embodiments are not to be construed as limiting the scope of the invention in any manner.

DETAILED DESCRIPTION OF THE INVENTION

The invention will now be described in detail in relation to various embodiments and implementations thereof which are exemplary in nature and descriptively specific as disclosed. As is customary, it will be understood that no limitation of the scope of the invention is thereby intended. The invention encompasses such alterations and further modifications in the illustrated apparatus and method, and such further applications of the principles of the invention illustrated herein, as would normally occur to persons skilled in the art to which the invention relates.

In various embodiments, a portable compression device can be used to compress a mammal's, such as a human patient's, limbs or extremities (hereafter the term "limb" and "extremity" can be used interchangeably). In at least one embodiment, the portable compression device (hereafter "PCD"), can be non-pneumatic and can use mechanical compression of the patient's limbs to apply external pressure to at least a portion of the limb to thereby propagate blood flow return in the direction of the patient's heart. In various embodiments, the PCD can sequentially compress a portion of the limb or limbs of the patient to promote blood flow towards the patient's heart. In at least one embodiment, the PCD can accomplish this mechanical compression through the use of at least one frame, motor or actuator, drum, and flexible elongate member and/or strap. Hereinafter, the terms "motor" or "actuator" may be referred to interchangeably. In at least one embodiment, the PCD can be self-contained and lightweight, and can incorporate a power system and a control system. In further various embodiments, the PCD may be versatile such that it can be: (1) integrated into an elastic or resilient sleeve configured to circumscribe at least a portion of the patient's limb, (2) placed directly onto at least a portion of the patient's limb, and/or (3) at least partially integrated into a structural support boot (e.g., Crow Walker boot), which can be worn by the patient. In other various embodiments, the PCD can be used and/or applied to at least a portion of the patient's limb as necessary for any suitable treatment. In various embodiments, the PCD can be used on peripheral sources of DVT (e.g. upper arm unilaterally or bilaterally, lower thigh unilaterally and/or bilaterally or lower calve unilaterally or bilaterally), while only creating very minimal physical limitations to the patient's ability to ambulate or function. In at least one embodiment, the PCD can operate quietly during operation such that the PCD does not interfere with the social behavior or interactions of the patient.

In various embodiments, the PCD may comprise a structural frame supporting one or more actuators, drums, straps, a controller for the actuator, and/or a power supply for the actuator. The components of the PCD are described herein in various embodiments to facilitate different usage scenarios. More specifically, the versatile PCD of the present invention can be offered in various embodiments or configurations to adapt to the treatment and prophylactic needs of particular patients. These various embodiments can facilitate case-specific applications for each patient and/or each patient's limb (s) to minimize any functional impact on the patient during use or treatment. Of course, it is envisioned that those skilled in the art will be able to use the PCD in other various embodiments or configurations, which are also within the scope and spirit of the present invention.

In at least one embodiment, a drive shaft of an actuator can be operably engaged with a drum such that the actuator can move the drum at least between a first position and a second position. In various embodiments, the drum of the PCD may interact and/or be engaged with a flexible elongate member and/or a resilient or non-resilient strap (the terms "flexible elongate member" and "strap" can be referred to interchangeably hereafter) which is configured to at least partially and/or fully surround a portion of a patient's limb. In at least one embodiment, the PCD, via the strap, can be used to apply a compressive force to the limb upon movement of the drum by the actuator at least between the first position and the second position. As the actuator moves, slides, and/or rotates the drum, in a clockwise, counterclockwise, axial, and/or other suitable direction, the circumference of the strap engaged with the limb can increase or decrease, thereby applying a tensile or compressive force to, or releasing the tensile or compressive force from, the patient's limb. In various embodiments, a controller system may sequentially command a plurality of the actuators to activate, thereby applying a compressive force to the patient's limb from the portion of the frame furthest from the patient's heart, or the distal-most portion, to the portion of the frame closest to the patient's heart, or the proximal-most portion, to encourage blood flow return to the heart. In at least one embodiment, for use in treating other various conditions, the PCD may compress the limb from the proximal-most portion of the frame to the distal-most portion of the frame. In various embodiments, for use in treating still other various conditions, the PCD may compress the limb with no particular order, or a random order, i.e., neither proximal to distal nor distal to proximal, for example. In still other various embodiments, another sequence of compression can be used to suit any particular treatment need. The terms "proximal" and "distal" are used herein with respect to the distance from the patient's heart.

In various embodiments, the mechanical PCD can comprise one or more frames, actuators, drums, straps, controllers for the actuators, and/or power supplies. In at least one embodiment, the PCD may be at least partially self-contained such that the frame can house the actuator, drum, and/or the power/control system. Initially, the components of the PCD will be discussed in detail before referring to various exemplary embodiments or configurations of the PCD which are illustrated in the figures. The components may be referred to below in the singular or the plural, but for purposes of this description, the singular can mean the plural and the plural can mean the singular.

In various embodiments, the frame of the PCD may be comprised of any suitable type of rigid and/or semi-rigid material, such as metal, fiberglass, carbon fiber, plastic, including, but not limited to, ABS and/or PVC, and/or wood. In at least one embodiment, any other suitable rigid and/or semi-rigid material can be used to form the frame of the PCD. In other various embodiments, any other non-rigid, semi-flexible, and/or flexible frame material can be used to comprise the frame of the PCD.

As set forth in the various exemplary embodiments which are illustrated in the figures, the frame of the PCD can take on various configurations while still retaining a similar function and/or purpose. In various embodiments, the frame may form the foundation or base of the PCD and can be connected to and/or house the actuator and/or drum. In at least one embodiment, the frame can also provide slotted portions situated thereon which can be configured to slidably guide the straps as the straps at least partially circumscribe the patient's limbs. In various embodiments, the frame may also be structurally designed to be resilient and durable so as to not fracture and/or deform due to cyclic stresses that occur during operation of the PCD. In at least one embodiment, the frame can be the portion of the PCD that is secured to the patient's limb indirectly by the use of the straps and/or through the use of a structural support boot and/or resilient sleeve as referenced above. As illustrated in various exemplary embodiments, each frame may include apertures defined therein which can be configured to accept rods, pins, dowels, connection members, and/or other linkages such that two or more independent frames can be operably linked together and function as a unit. In various embodiments, a plurality of frames can be integral to the connection member, for example. In other various embodiments, the frame can comprise a single unit which is attached to only one actuator, drum, and strap combination but is meant to be attached to, and/or configured to cooperate with, other frames with interconnecting linkages (e.g., dowels, pins, rods, connection members, etc.). In still other various embodiments, the frame can be a single unit configured for attachment to one actuator, drum, and strap combination and can be used independently and/or in combination with other PCDs, but not be formally attached to the other PCDs. In further various embodiments, the frame may be used to mount the controller and power supply system of the PCD, for example.

In various embodiments, the actuators of the PCD may be motors, such as DC geared motors and/or stepper-motors, for example. In various embodiments, the actuators can be operably linked to the drum and provide the necessary torque to the drum to tighten (i.e., at least partially coil the strap around a portion of the drum) and loosen (i.e., at least partially uncoil the strap from a portion of the drum) to a prescribed strap tension. In at least one embodiment, the actuator can be resilient enough to perform this task cyclically for the extended duration of the treatment and the expected lifespan of the PCD. In other various embodiments, the actuator can include a linear actuator having a piston configured to extend and retract therefrom. In at least one embodiment, the linear actuator can compress the strap upon extension and release the tension on the strap upon retraction, as discussed in further detail below.

Further to the above, in various embodiments, the drums of the PCD can be made of any resilient and/or rigid material, such as plastic, metal, fiberglass, carbon fiber, wood, and/or any other suitable material, for example. In at least one embodiment, the drums can also be made of a semi-rigid and/or flexible material. In various embodiments, the drums can have a flat, circular, ovate, triangular, rectangular, and/or square cross-section and/or can have any other suitable cross-section, including any combination of the recited cross-sectional shapes. In at least one embodiment, the drums can have an aperture defined through a central axis and/or in other suitable areas, which allows the drum to be fixed to one end of the drive shaft, while the other end of the drive shaft is operatively engaged with the actuator. In various embodiments, the aperture in the drum can be off-set from the central axis of the drum such that the drum forms an eccentric or a cam, for example. In at least one embodiment, the aperture and shaft connection can include any suitable locking member or threads to allow the drum to rotate and/or move in unison with the shaft, for example. In other various embodiments, the drum can be attached to the actuator by any suitable means. In various embodiments, the drum may have a slot defined therein. In at least one embodiment, the slot or aperture can be defined proximate to the central axis of the drum or any other suitable area, thereby allowing the strap to engage the slot or aperture and optionally pass through the drum. In various embodiments, by engaging the strap with the slot, the drum can be rotated by the actuator in a clockwise and/or counterclockwise direction to at least partially coil the strap around itself and/or a portion of the drum and thereby apply a tensile force to the strap and in turn apply a compressive force to the patient's limb. In other various embodiments, the strap may also be fixed to the outside or other portion of the drum by any suitable means, such as glue and/or pins, for example.

In various embodiments, the strap can be configured to at least partially circumscribe the patient's limb, travel through the slotted portion and/or portions in the frame, and pass through the slot in the drum, for example. In at least one embodiment, the straps can be made of any suitable material which is durable enough to withstand a number of cycles of tension, applied by the actuators, without significantly elongating, wearing out, and/or tearing. In at least one embodiment, the strap can be a composite strap, where one type of material passes through the drum and another type of material(s) at least partially circumscribes the patient's limb, for example. In other various embodiments, a plurality of straps each having a different modulus of elasticity can be used to vary the compressive force applied to a portion of the patient's limb when the drum and actuator apply the same retractive force to each of the plurality of straps.

Although the straps are illustrated in some of the figures as a continuous member, in various embodiments, the straps can be non-continuous and have two ends, for example. In at least one embodiment, the two strap ends can allow the patient to apply and remove the straps of the PCD, as needed. In various embodiments, the strap ends may be secured to each other through various connection members, including a buckle, Velcro®, a snap, and/or any other suitable connection members that are strong enough to undergo the expected cyclic tension applied to the strap during use of the PCD. For simplicity, in various embodiments, the strap is illustrated as having a single, continuous width, although in practice the strap may be configured to have various geometries and/or dimensions. In at least one embodiment, the strap can be flared at a portion which is adjacent to each side of the drum such that the portion of the strap contacting the patient's limb is wider than the portion passing through the drum and/or frame. This dimensional variation can cause the compressive force to be distributed across a wider area of the patient's limb to make the treatment more comfortable for the patient. In at least one embodiment, multiple compressive straps can be used to perform compression and/or sequential compression of the patient's limb. These multiple compressive straps, again, can be used to distribute the compressive forces applied to the patient's limb.

In various embodiments, the controllers for the actuators of the PCD may be any analog and/or digital controller that can accurately and repeatedly apply suitable power to the actuators to achieve the desired strap tension but without overtensioning the strap. In at least one embodiment, if more than one actuator is included in the PCD, the controller can be programmed to synchronize the activations of the actuators to allow the straps to be tensioned from the distal-most strap to the proximal-most strap or from the proximal-most strap to the distal-most strap, for example. In at least one embodiment, this type of actuator synchronization can promote blood flow toward the proximal-most portions of the limb and toward the patient's heart. Thus, if several controllers are used (one for each actuator and/or one for a plurality of actuators), the controllers can communicate with each other to allow for the synchronization. The controller communication can be accomplished by any suitable communication means such as wireless communication, for example. If one controller is used in an embodiment having several actuators, this synchronization may be implicit when attaching the several actuators. In various embodiments, the controller can include a fail-safe mechanism, for safety reasons, which can cause the actuator drive shaft to release the tensile force on the drum when a critical tension is reached in the strap to thereby maintain a suitable comfort level for the patient. For typical analog or digital DC controllers, a simple current limiting controller, which reverses the polarity on the actuators at a preset current, may be sufficient to run the PCD. In at least one embodiment, a high-level current cutoff switch and/or a fuse may be used as another suitable fail-safe mechanism, for example. In various embodiments, if stepper motors are used as the actuators, control may be possible by prescribing a certain number of steps in coordination with monitoring the motor's current draw, for example.

In various embodiments, the PCD may be battery operated thereby allowing for full portability and in turn maneuverability for the patient. In at least one embodiment, the power supply for the PCD can be dependent on the requirements of the actuators and controllers. In such embodiments, a lithium-ion or nickel-metal-hydride battery which is suitable for medical devices can be used. The capacity and voltage of these various batteries may be dependent on the current draw from the actuators and/or controllers and the expected use time between recharging. In various embodiments, an integrated battery and included battery charger/power supply can allow the patient to easily transition from a fixed position (during battery charging or power supply-connected use) to a mobile position by simply unplugging the PCD. In at least one embodiment, an alternate AC power supply may be included with the PCD, as well as a battery charger. In various embodiments, the battery charger's electronics may be integrated into the PCD and/or be external thereto. In such embodiments, both direct contact (i.e., through a wire) or non-contact (i.e., through induction) may be used to power the PCD through an AC outlet and/or recharge the batteries, for example.

In various embodiments, referring to FIGS. 1-6, the PCD 10 can have a connection member 12 attached, by any suitable means, to one or more frames 14. In at least one embodiment, the connection member 12 can be formed integral with the one or more frames 14, for example. In such an embodiment, the connection member 12 can be comprised of any suitable rigid and/or semi-rigid material, such as plastic, wood, fiberglass, carbon fiber, and/or metal, for example. In various embodiments, any number of frames 14 can be situated on and/or formed integral with the connection member 12 with each frame 14 having at least one actuator 16 and one drum 18 engaged therewith. In such an embodiment, the drum 18 can engage a flexible elongate member, such as a strap 20, for example, such that when the drum 18 is rotated, the length and/or diameter of the strap 20 at least partially surrounding a portion of the patient's limb can either be shortened, to provide the compressive force to the limb, or lengthened, to release the compressive force on the limb (see, e.g., FIGS. 5 and 6). In various embodiments, the frame 14 can include slotted portions 26, which can be configured to guide the strap 20 as it circumscribes the patient's limb. In at least one embodiment, the slotted portions 26 can also prevent the strap from becoming tangled with the connection member 12 and/or the frame 14, for example.

In various embodiments, the drum 18 may include a strap opening 24 defined therein, which can be configured to allow the strap 20 to be threaded through the drum 18. In such an embodiment, each strap 20 can be threaded through a strap opening in each drum 18, such that upon actuator actuation, the straps 20 can each be coiled and/or uncoiled about at least a portion of the circumference and/or perimeter of the drum 18, for example. In other various embodiments, the strap 20 can be connected to the outer surface and/or outer perimeter of the drum 18 using any suitable type of connection member. In at least one embodiment, the strap 20 can be inserted into the slotted portions 26 of the frame 14 before and/or after circumscribing a portion of the patient's limb. As an example, and not by limitation, the actuator 16 that is configured to be engaged with the drum 18 can be situated on top of a portion of the frame 14 that houses the drum 18. In various embodiments, the drum 18 and actuator 16 may be operably connected to each other by a drive shaft extending from the actuator 16 which operably engages and aperture (not illustrated) defined in the drum 18, for example. In such a fashion, the actuator, owing to the drive shaft's engagement with the drum, can rotate the drum in any suitable direction.

Figure 6:
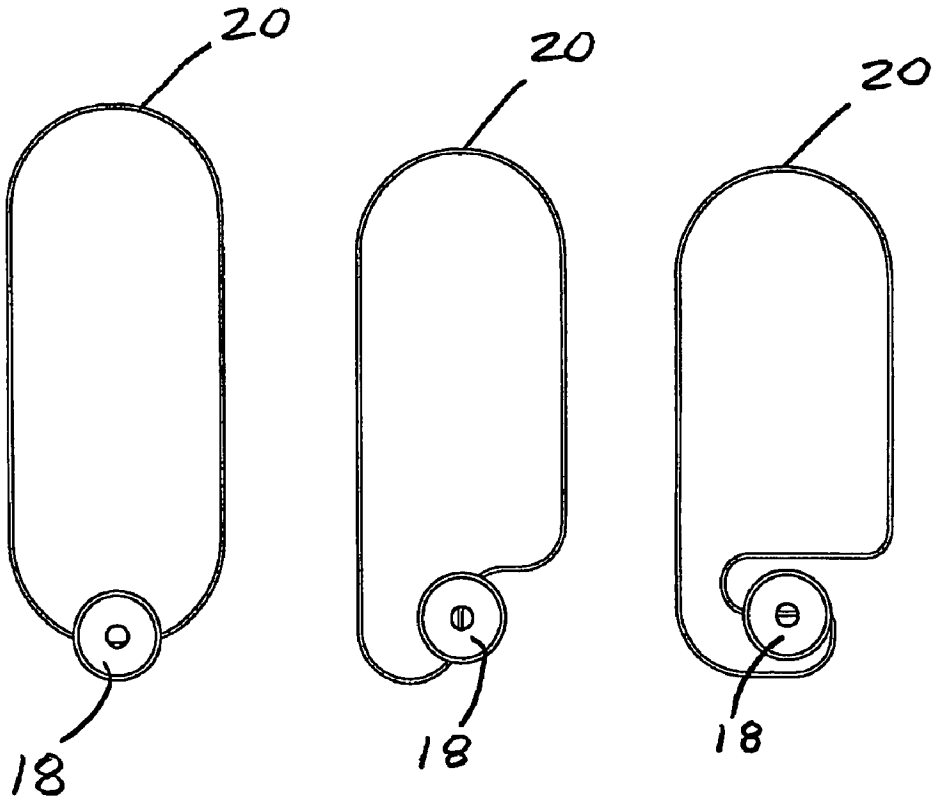
FIG. 6 is a top view of the strap and drum of the portable compression device of FIG. 1, showing various phases of compression of the strap by the drum.
Figure 5:
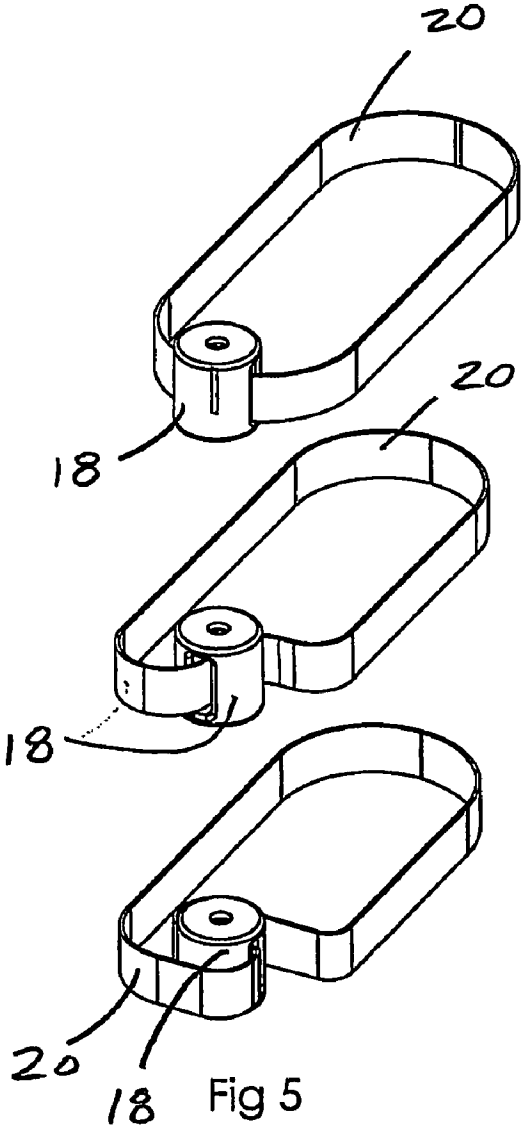
FIG. 5 is a perspective view of a strap and a drum of the portable compression device of FIG. 1, showing various phases of compression of the strap by the drum.
Figure 8:
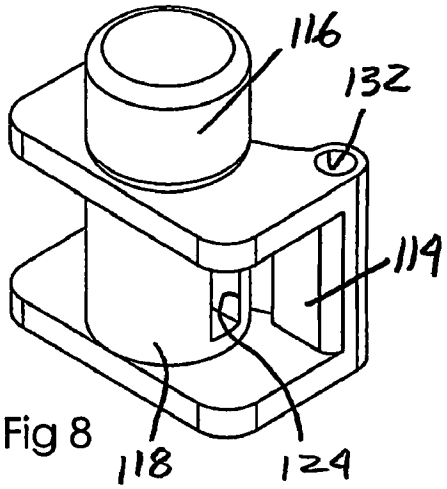
FIG. 8 is an assembled perspective view of the actuator, drum, and frame of the portable compression device of FIG. 7.
Figure 9:
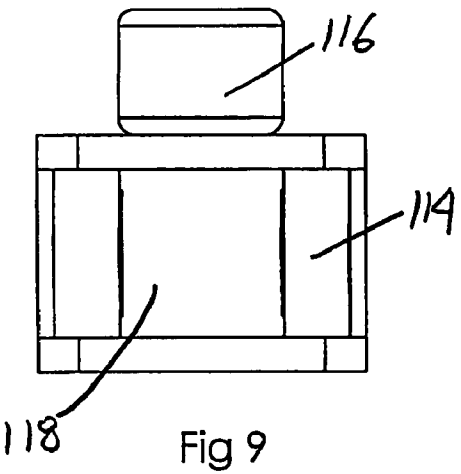
FIG. 9 is an elevation view of the actuator, drum, and frame of the portable compression device of FIG. 7.
Figure 7:
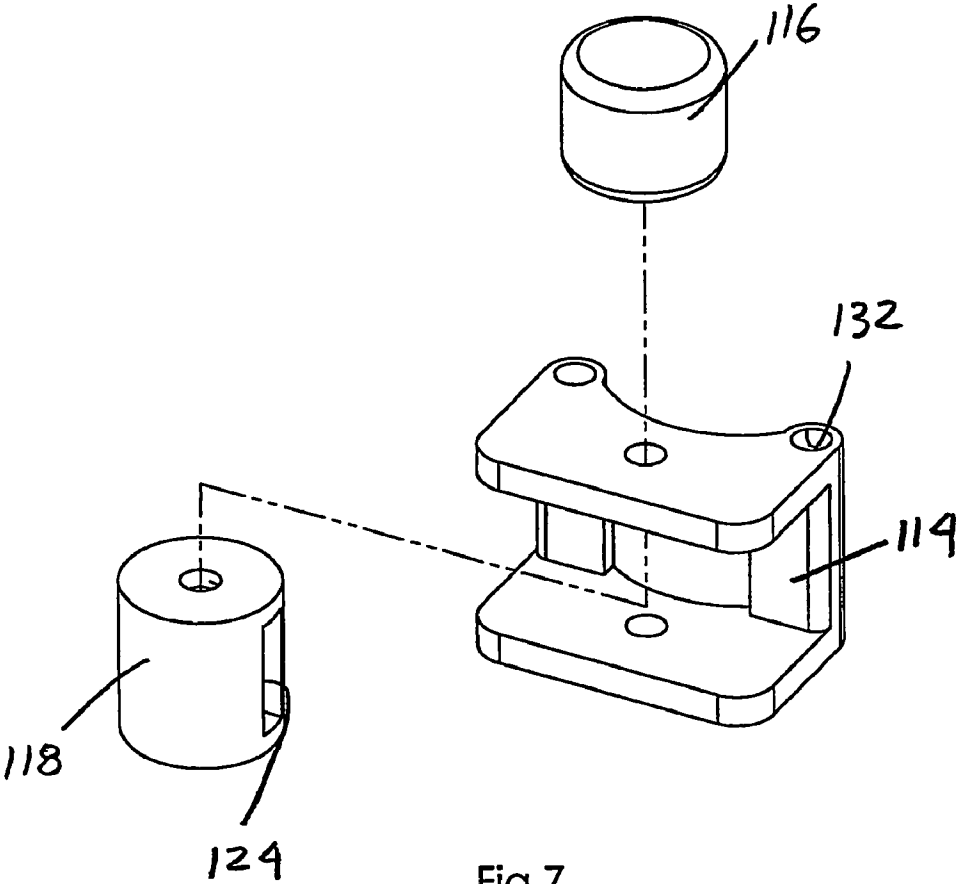
FIG. 7 is a perspective exploded view of an actuator, drum, and frame of a portable compression device in accordance with one non-limiting embodiment of the present invention.
Figures 10, 11, 12, 13, 14:
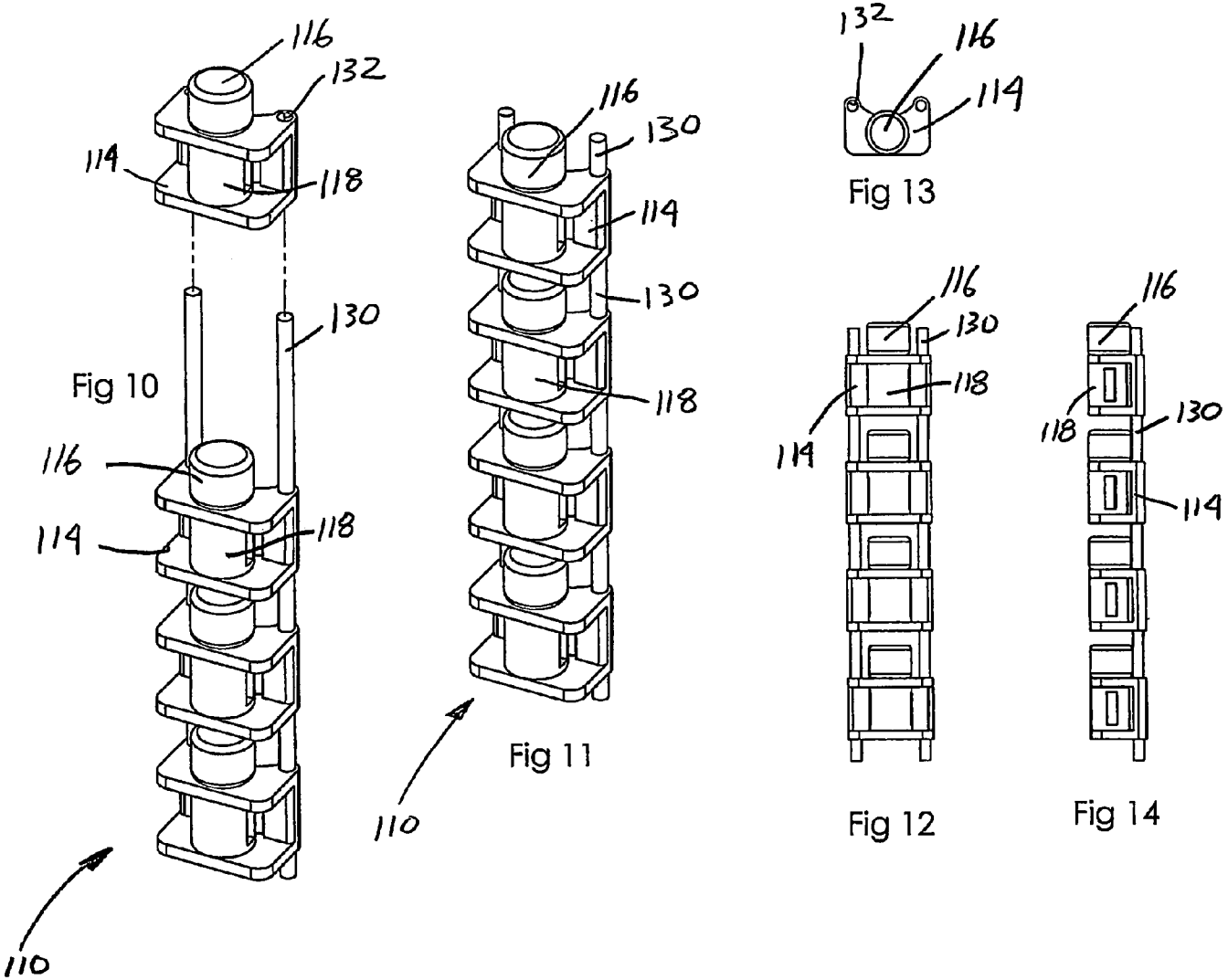
FIG. 10 is a partial assembled perspective view of a plurality of actuators, drums, and frames of the portable compression device of FIG. 7, being assembled onto two connection members.
FIG. 11 is an assembled perspective view of the plurality of actuators, drums and frames of the portable compression device of FIG. 10.
FIG. 12 is an elevation view of the plurality of actuators, drums, and frames of the portable compression device of FIG. 11.
FIG. 13 is a top view of the portable compression device of FIG. 11.
FIG. 14 is a side view of the plurality of actuators, drums, and frames of the portable compression device of FIG. 11.
Figure 18:
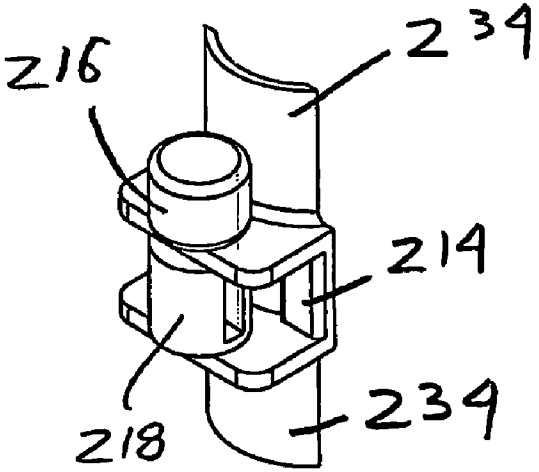
FIG. 18 is a perspective view of the actuator, drum, and frame of the portable compression device of FIG. 15.
Figure 17:
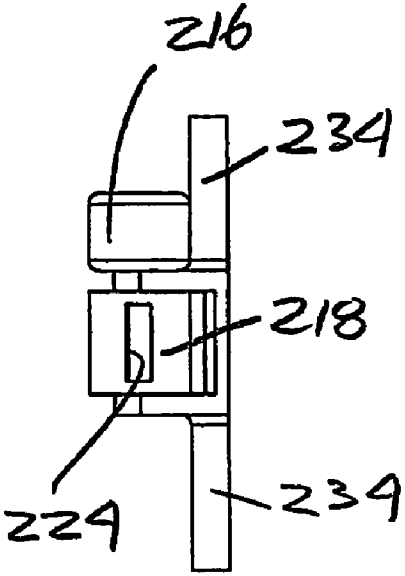
FIG. 17 is a side view of the actuator, drum, and frame of the portable compression device of FIG. 15.
Figure 16:
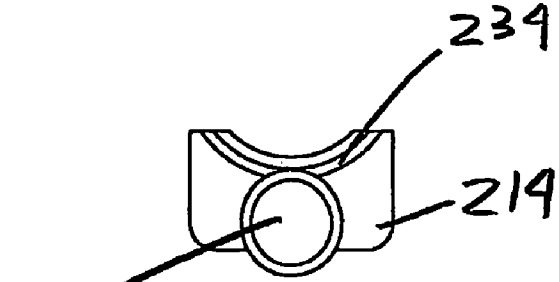
FIG. 16 is a top view of the actuator, drum, and frame of the portable compression device of FIG. 15.
Figure 15:
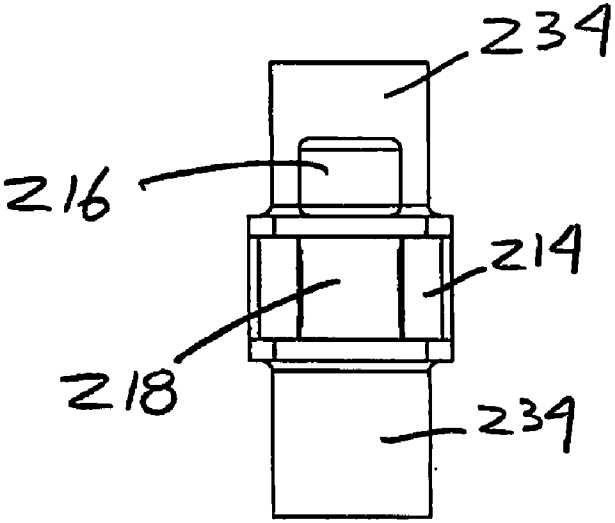
FIG. 15 is an elevation view of an actuator, a drum, and a frame of a portable compression device in accordance with one non-limiting embodiment of the present invention.

In various exemplary embodiments, FIGS. 5 and 6 demonstrate how the strap 20 can be coiled around at least a portion of the drum 18 during rotation of the drum. In such an embodiment, the rotation of the drum 18 may effectively shorten the length of the strap 20 and thereby apply a compressive force to the patient's limb and encourage blood flow toward the heart of the patient, for example. In various embodiments, FIGS. 5 and 6 demonstrate a progression from when the strap 20 is uncoiled on the drum 18 (i.e., minimum compression on the limb) to when it is coiled around at least a portion of the drum 18 (i.e., maximum compression on the limb). In at least one embodiment, the strap 20 can be coiled around the drum 18 as many times as necessary to apply any suitable compressive force to a portion of the patient's limb. In various embodiments, the strap 20 may be coiled around the drum 18 more than one time on a small limb versus less than one time on a large limb, for example.

In various embodiments, referring to FIGS. 7-14, a PCD 110 can include an alternative frame 114. In such an embodiment, an actuator 116 and a drum 118 can be situated on and/or engaged with the frame 114, for example. In at least one embodiment, the frame 114 may be similar to the frame 14 of FIG. 1, described above, however, the frame 114 may also include at least one frame hole 132, configured to accept a rod, dowel, and/or a pin 130. In various embodiments, the PCD 110 can eliminate the connection member 12, and may instead add one or more rods, dowels, and/or pins 130. In at least one embodiment, the rods, dowels, and/or pins 130 can engage a plurality of frames 114 (see, e.g., FIGS. 10-12 and 14). Although the straps are not shown in FIGS. 7-14, the straps can be provided with this embodiment similar to the straps 20 illustrated in FIGS. 1-6. In various embodiments, the rods, dowels, and/or pins 130 can be rigid, semi-rigid, and/or flexible. In at least one embodiment, the rods, dowels, and/or pins 130 can be shaped, formed, and/or contourable to conform to the contour of the patient's limb being treated, for example. In other various embodiments, the rods, dowels, and/or pins 130 can be replaced with any other elongate member having any suitable shape and material. In at least one embodiment, the elongate member can be formed such that it conforms to the patient's limb when applied thereto. In various embodiments, the compressive forces applied to the patient's limb can be applied from the distal-most portion of the rods, dowels, and/or pins 130 to the proximal-most portion of the rods, dowels, and/or pins 130, as discussed above. In other various embodiments, the compressive forces can be applied in a random pattern and/or can be applied from the proximal-most portion of the rods, dowels, and/or pins 130 of frame 114 to the distal-most portion of the rods, dowels, and/or pins 130. In various embodiments, any suitable number of frames, actuators, drums, and/or straps can be used with the dowels, rods, and/or pins 130.

In various embodiments, referring to FIGS. 15-21, a PCD 210 can include a frame 214 that incorporates first and second projections 234. In at least one embodiment, the projections 234 can extend laterally and/or in any other suitable direction. In various embodiments, the projections 234 can be comprised of similar materials as the frame 14 of FIG. 1, as discussed above, and can be rigid, semi-rigid and/or flexible. In at least one embodiment, the projections 234 can be fitted to a portion of a particular patient's limb for added comfort.

Figure 1:
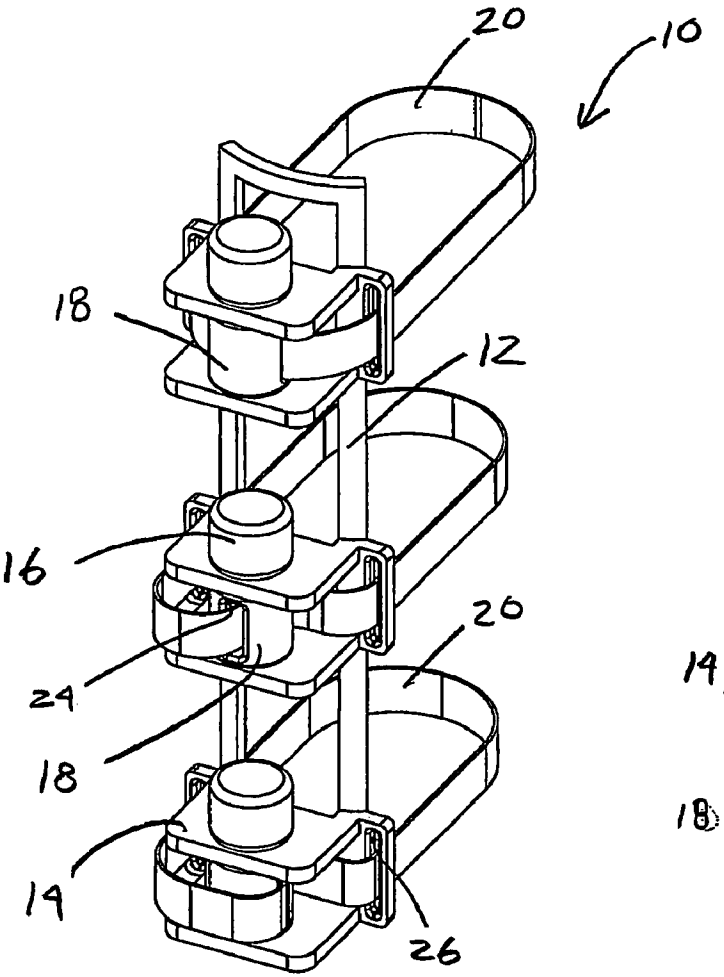
FIG. 1 is a perspective view of a portable compression device in accordance with one non-limiting embodiment of the present invention.
Figures 19, 20, 21, 22:
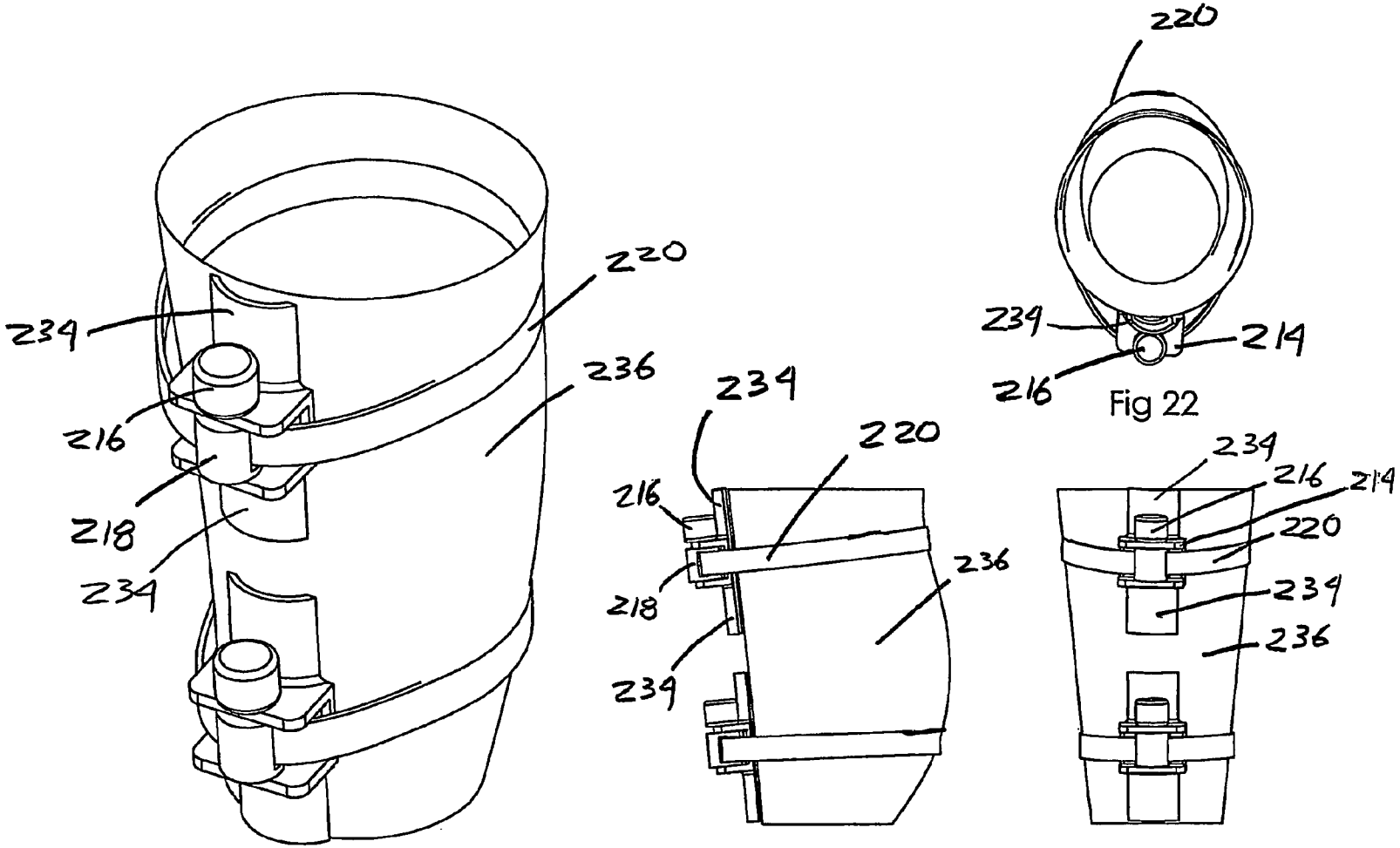
FIG. 19 is a perspective view of two portable compression devices positioned around a resilient sleeve which is configured to circumscribe a patient's limb in accordance with one non-limiting embodiment of the present invention.
FIG. 20 is a side view of the two portable compression devices of FIG. 19.
FIG. 21 is an elevation view of the two portable compression devices of FIG. 19.
FIG. 22 is a top view of the two portable compression devices of FIG. 19.
Figures 23, 24, 25, 26, 27:
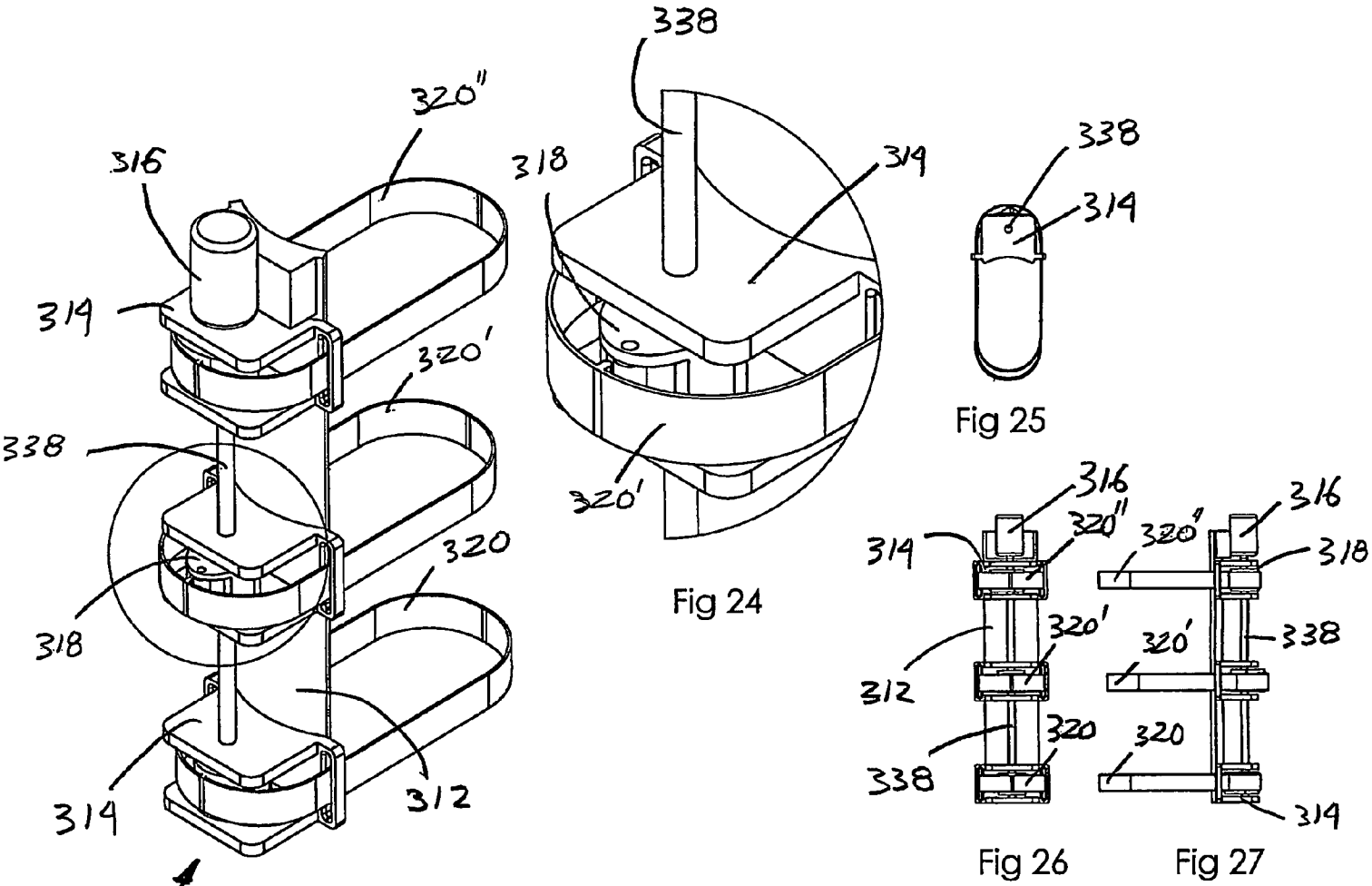
FIG. 23 is a perspective view of a portable compression device in accordance with another non-limiting embodiment of the present invention.
FIG. 24 is a partial perspective view of FIG. 23, showing one embodiment of a drum or cam of the portable compression device.
FIG. 25 is a top view of the portable sequential compression device of FIG. 23.
FIG. 26 is an elevation view of the portable compression device of FIG. 23.
FIG. 27 is a side view of the portable compression device of FIG. 23.
Figures 28, 28A, 29, 30, 31:
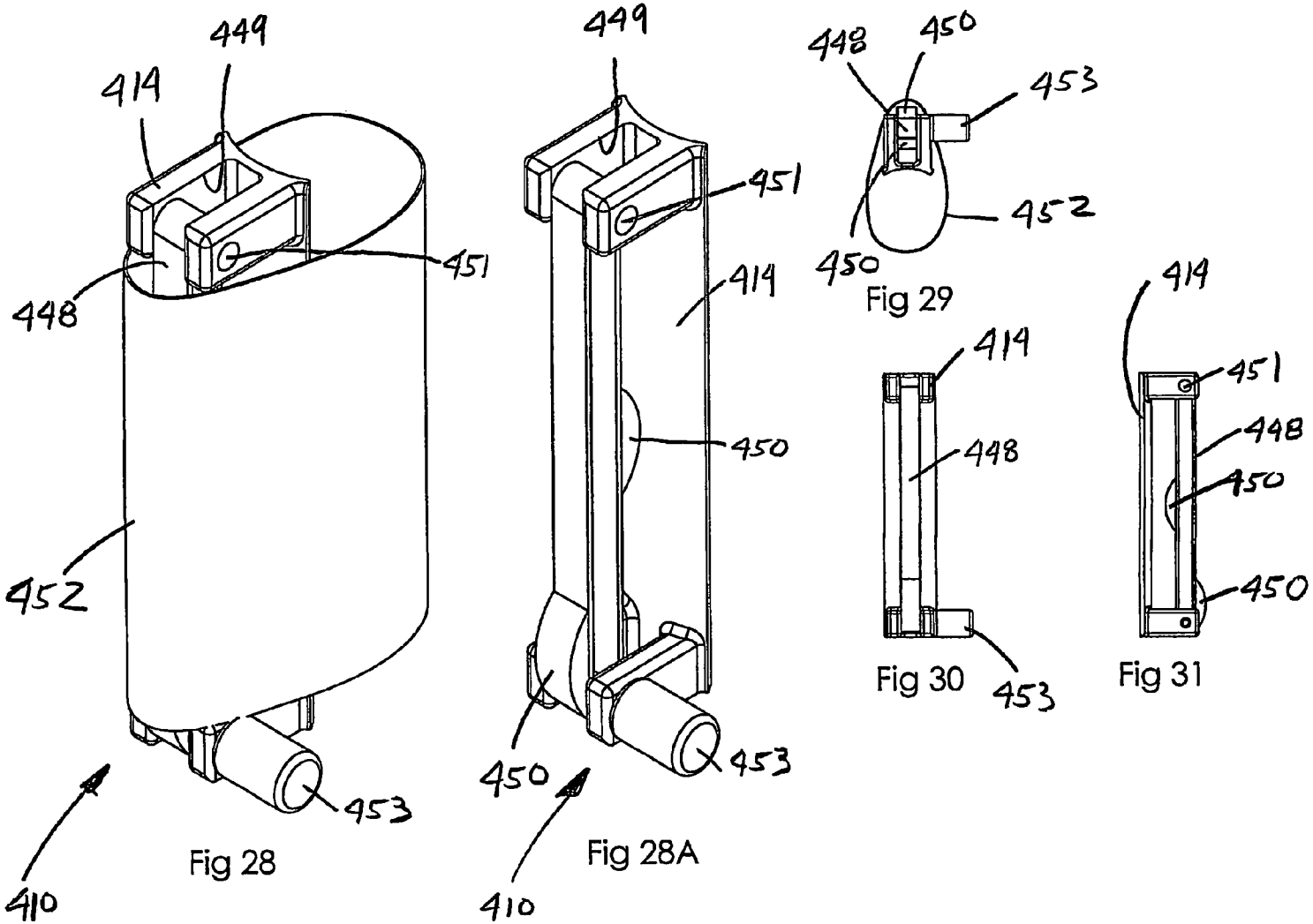
FIG. 28 is a perspective view of a portable compression device in accordance with another non-limiting embodiment of the present invention.
FIG. 28A is a perspective view of the portable compression device of FIG. 28 with the resilient sleeve removed.
FIG. 29 is a top view of the portable compression device of FIG. 28.
FIG. 30 is an elevation view of the portable compression device of FIG. 28A.
FIG. 31 is a side view of the portable compression device of FIG. 28A.
Figure 33:
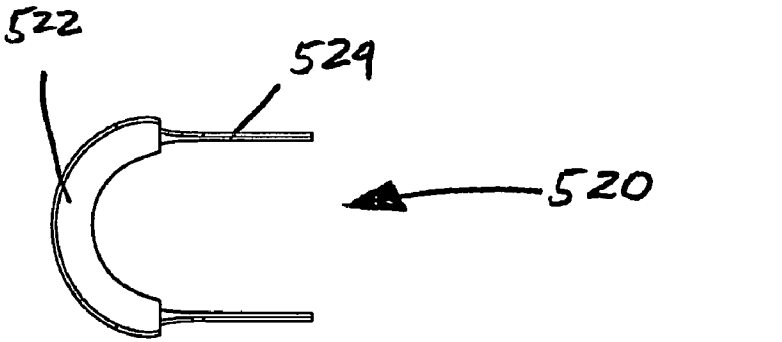
FIG. 33 is a top view of the arcuate strap of the portable compression device of FIG. 32.
Figure 34:
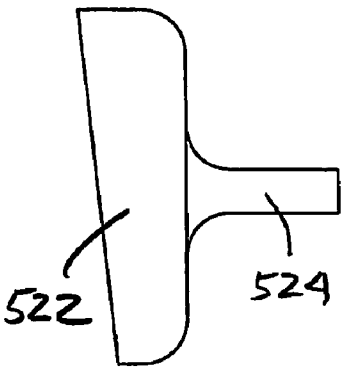
FIG. 34 is a side view of the arcuate strap of the portable compression device of FIG. 32.
Figure 35:
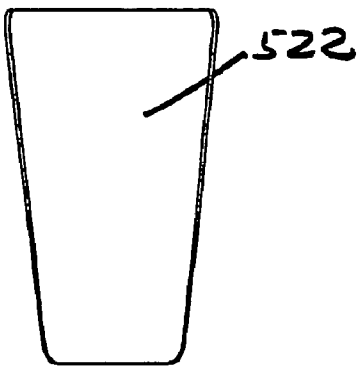
FIG. 35 is an elevation view of the arcuate strap of the portable compression device of FIG. 32.
Figure 32:
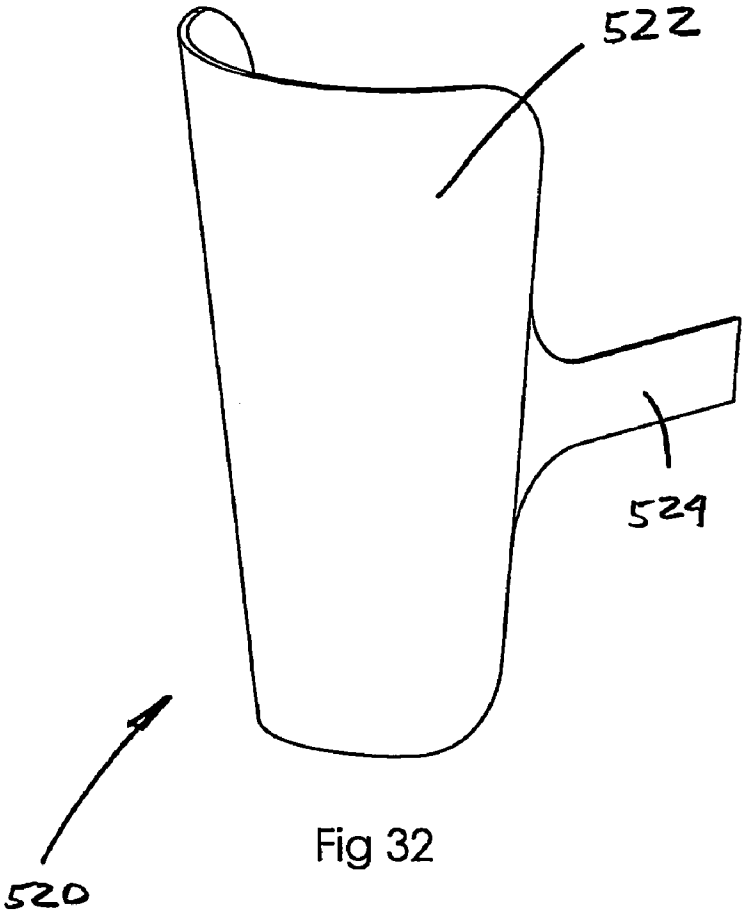
FIG. 32 is a perspective view of an arcuate strap of a portable compression device in accordance with one non-limiting embodiment of the present invention.

Similar to other various embodiments, a PCD 210 can use one or more actuators 216, drums 218, and straps 220 which can be similar to the actuators 16, drums 18, and straps 20 of FIG. 1, as discussed above. In at least one embodiment, the first and second projections 234 can allow the frame 214 to be secured to a resilient sleeve 236 and/or other suitable limb attachment member. One or more PCDs 210 including projections 234 can be inserted into and/or positioned around a sleeve of the resilient sleeve 236 (see, e.g., FIGS. 19-22). In various embodiments, the straps 220 and first and second projections 234 can fully conform to the limb being treated to provide a more efficient compressive force to the limb and to promote blood flow toward and/or away from the patient's heart, for example. Although, two PCDs working in parallel are illustrated in FIGS. 19-21, it is to be understood that a single PCD or more than two PCDs would accomplish acceptable results.

In various embodiments, referring to FIGS. 23-27, a connection member 312 can be integral with one or more frames 314 and/or can have one or more frames 314 engaged therewith. In various embodiments, the frames 314 can be engaged with the connection member 312 by any suitable method and can be attached and/or engaged with an actuator 316, cam 318, and a strap 320, 320', and/or 320", for example. In at least one embodiment, the PCD 310 can have at least one actuator 316 operably engaged with a drive shaft 338 such that the actuator 316 can rotate the drive shaft 338 in a clockwise and/or a counterclockwise direction, for example. In various embodiments, a plurality of cams 318 can each include a camming surface and be operably engaged with the drive shaft 338. In such an embodiments, the cams 318 can be positioned within each frame 314 and can be offset from each other from the perspective of a longitudinal axis of the drive shaft 338 (see, e.g., FIGS. 23 and 27). In various embodiments, the drive shaft 338 can be engaged with the cams 318 at a point other than on a central axis of the cams such that a larger portion of each of the cams is on one side of the drive shaft 338 and a smaller portion of each of the cams can be on the other side of the drive shaft 338. This offsetting of the cams can cause the cams to horizontally reciprocate relative to the drive shaft as the drive shaft is rotates in a clockwise or counter-clockwise direct, for example. In other various embodiments, the drive shaft 338 can engage the cams on a central axis thereof. In still other various embodiments, the drive shaft 338 can engage the cams 318 at different locations on each cam 318 to allow only one cam at a time to contact and retract a strap 320, 320', and/or 320". In various embodiments, each strap can be positioned such that it can be contacted by the cam and/or the camming surface of the cam when the cam is rotated about the drive shaft such that the strap can be tensioned and untensioned to compress and decompress the patient's limb.

Further to the above, in various embodiments, the cams 318 may be offset from each other in such a fashion as to allow tension or a compressive force to be applied to the distal strap 320, then to the middle strap 320' or straps, and then to the proximal strap 320", as the drive shaft 338 rotates and thereby rotates the cams 318. In at least one embodiment, the sequential compression of the straps 320, 320', and 320" can force blood toward the patient's heart, for example. In other various embodiments, the drive shaft 338 and cams 318 can be configured such that as the drive shaft 338 rotates, the proximal strap 320" is tensioned, then the middle strap(s) 320' is/are tensioned, and finally the distal strap 320 is tensioned. In still other various embodiments, any other suitable strap tensioning sequence can be used, such as tensioning the middle strap 320' first, for example.

In various embodiments, referring to FIGS. 28-31, a PCD 410 can include a frame 414 which can be surrounded by a cuff or sleeve 452. In at least one embodiment, the sleeve 452 can be comprised of an elastic, resilient, and/or flexible material and can be configured to be wrapped around or slid onto a portion of a limb of a patient. In at least one embodiment, the frame 414 can have a channel 449 defined parallel to, or substantially parallel to, the longitudinal axis of the frame. In various embodiments, the channel 449 may also be parallel to, or substantially parallel to, at least a portion of the limb being compressed. In various embodiments, the channel 449 may be configured to accept a belt 448 or a chain therein. In at least one embodiment, a cable or any other suitable member can be used in place of the belt 448, for example. In various embodiments, the belt or chain 448 can be wrapped around two or more gears, wheels, and/or pins 451, which can be configured to rotatably drive the belt 448 at least partially within the channel 449 and about the gears, wheels, and/or pins. In at least one embodiment, at least one of the gears, wheels, and/or pins can be driven by any suitable actuator, such as actuator 453, for example.

In various embodiments, one or more cams 450 can be connected to the belt or chain 448, such that the cams 450 can rotate in unison with, or substantially in unison with, the belt 448. In such embodiments, the size and profile of the cams 450 can vary the compressive force applied to a portion of the patient's limb, for example. In various embodiments, the distance that the cam 450 extends from the belt 448 may be proportional to the magnitude of the compressive force applied to the limb. In at least one embodiment, a cam 450 extending from the belt 448 a distance of one half inch may apply a lesser compressive force than a cam 450 extending from the belt 448 a distance of 1 inch, for example.

In various embodiments, during actuation of the belt 448, the cam 450 can initially be positioned at a distal-most end of the channel 449 and be in contact with at least a portion of the sleeve 452. Then, upon movement of the belt 448, the cam 450 can then slide and/or move at least partially within and/or along the channel, while in contact with the sleeve 452, toward the proximal-most end of the channel 449. In at least one embodiment, this sliding and/or moving of the cam 450 can cause the sleeve 452 to tighten along an axis which can be transverse and/or perpendicular to the longitudinal axis of the channel 449. In various embodiments, as the cam 450 moves from the distal-most portion of the channel 449 to the proximal-most portion of the channel, a compressive force can be applied to a portion of the limb in a distal to proximal fashion, thereby promoting blood flow toward the patient's heart. In various embodiments, when the cam 450 nears the proximal-most gear, wheel, and/or pin 451, it can rotate around the gear, wheel and/or pin and can begin to travel toward the distal-most end of the channel 449 (see, e.g., FIG. 28*a*). In various embodiments, the cam 450 may not engage the sleeve 452 during travel toward the distal-most end of the channel. In at least one embodiment, when the cam 450 reaches the distal-most gear, wheel and/or pin 451, it can again engage the sleeve 452 at the distal-most end of the channel 449 and can begin traveling toward the proximal-most end of the channel, as discussed above.

In various embodiments, still referring to FIGS. 28-31, the cam or cams 450 can continuously rotate around the belt or chain 448 at any suitable speed for appropriate sequential compression of the sleeve 452 and a portion of the limb. In other various embodiments, the belt 448 can be operatively connected to any suitable timer mechanism which can activate the belt 448, as required. While one various embodiment has been discussed as having a compressive force being applied from a distal-most end to a proximal-most end of the channel, other various embodiments provide a compressive force from the proximal-most end of the channel to the distal-most end of the channel to accommodate various modalities merely be reversing the direction of the cam 450, i.e. rotating the cam about the channel counter-clockwise.

In various embodiments, referring to FIGS. 32-35, a strap 520 can be used with any of the various embodiments of the PCD discussed herein. In at least one embodiment, the strap 520 can have an arcuate portion 522 and one or more extension portions 524. In various embodiments, the arcuate portion 522 can be engaged with a portion of the limb of the patient while the extension portion 524 can be engaged with a drum, such as the drum 18, for example, and/or configured to be engaged with a cam, such as cam 318, for example. In such an embodiment, the drum or cams, when moved by the actuator, can create a tensile force on the extension portions 524 and in turn produce a compressive force on the arcuate portion 522 of the strap 520 at least partially circumscribing the patient's limb. In at least one embodiment, this compression force may be the greatest at the distal-most end of the arcuate portion 522 and the least at the proximal-most end of the arcuate portion 522 to thereby promote blood flow toward the patient's heart. These differing compressive forces can be due to the fact that there can be a shorter distance between the extension portions 524 and the distal-most portion when compared to the distance between the extension portions 524 and the proximal-most portion, for example. In various embodiments, two or more extension portions 524 can engage two or more frames, drums and/or cams, and actuator combinations. In at least one embodiment, the extension portions 524 can be connected to each other in the same fashion as the various other straps discussed herein.

Figure 37:
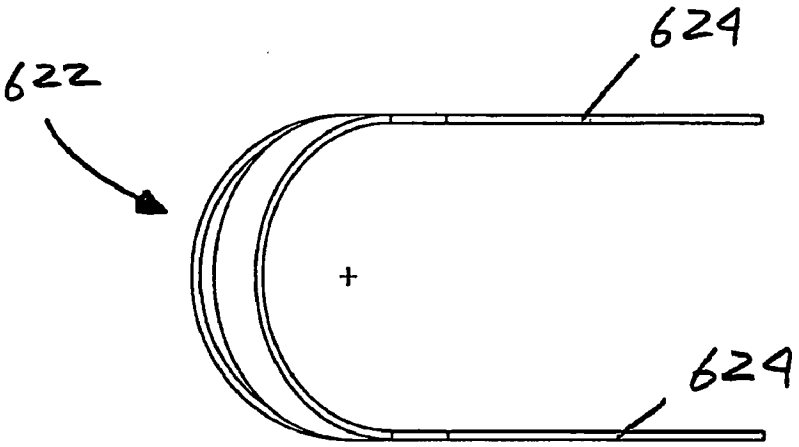
FIG. 37 is a top view of the arcuate strap of FIG. 36.
Figure 38:
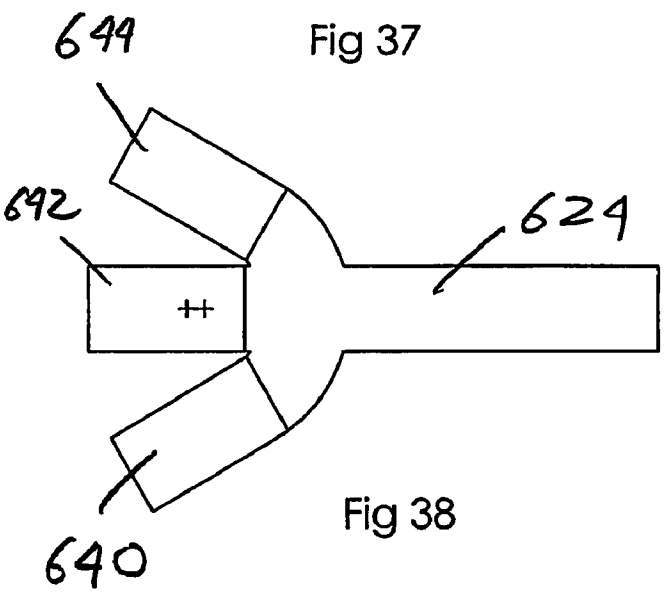
FIG. 38 is a side view of the arcuate strap of FIG. 36.
Figure 36:
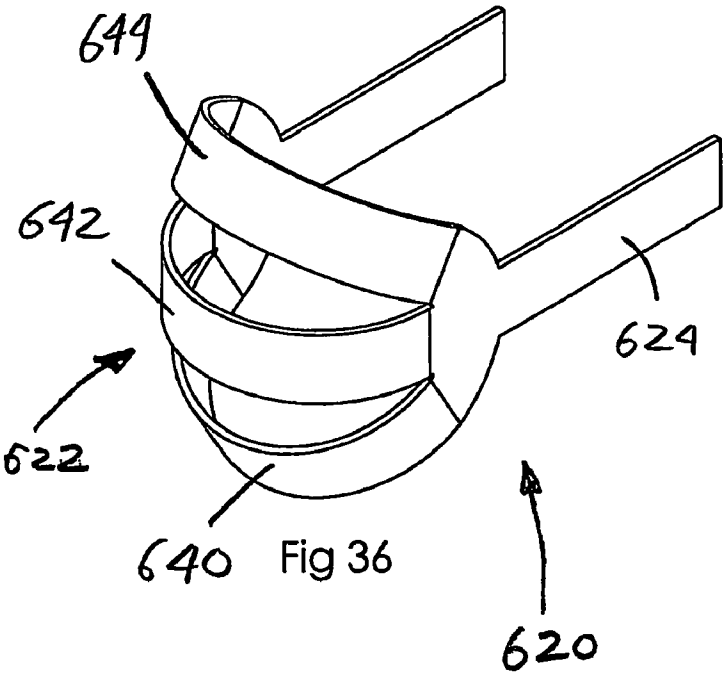
FIG. 36 is a perspective view of another arcuate strap of a portable compression device in accordance with one non-limiting embodiment of the present invention.
Figures 39, 40, 41, 42:
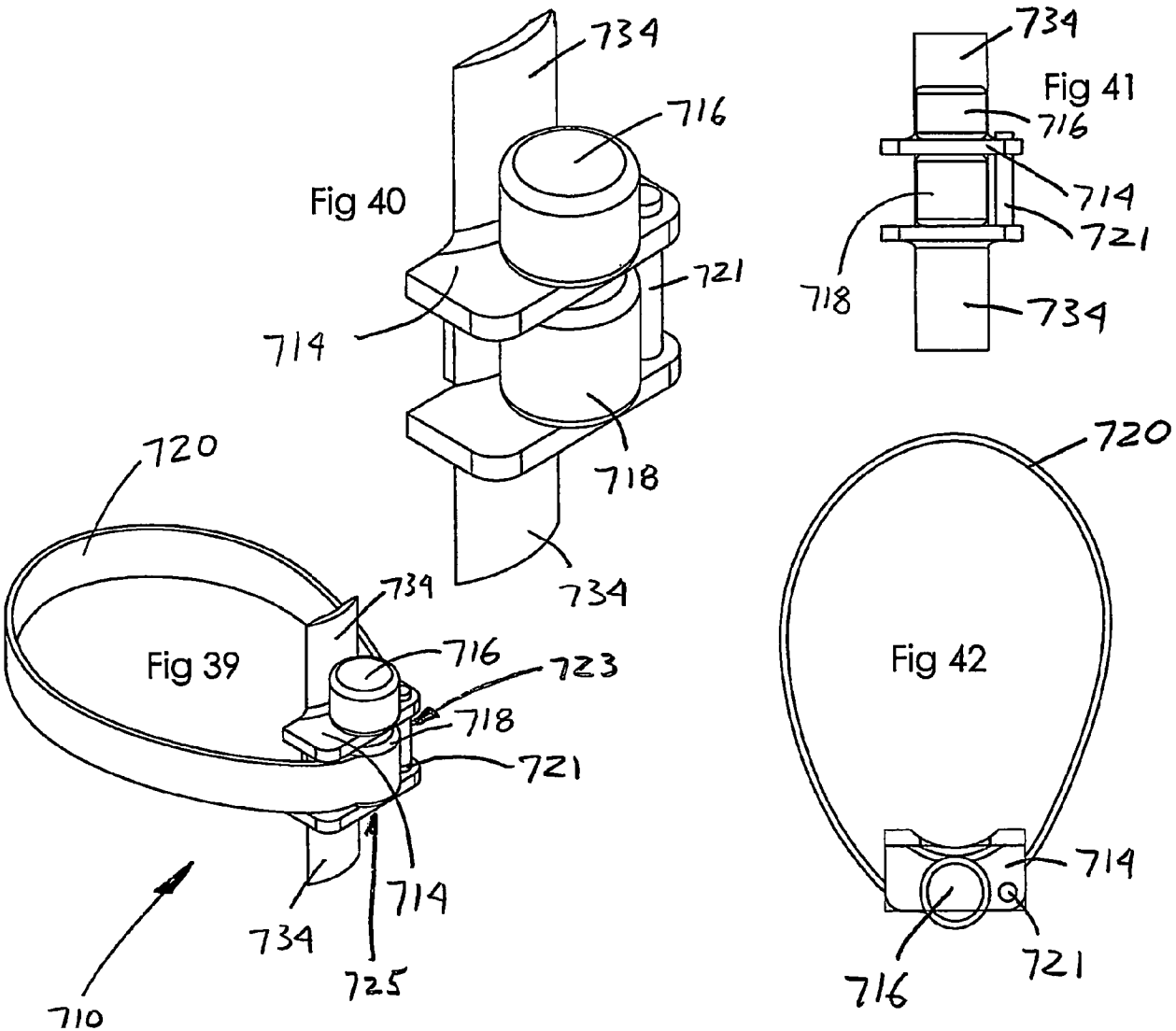
FIG. 39 is a perspective view of a portable compression device in accordance with one non-limiting embodiment of the present invention.
FIG. 40 is a perspective view of a portion of the portable compression device of FIG. 39 without a strap attached.
FIG. 41 is an elevation view of the portion of the portable compression device of FIG. 40.
FIG. 42 is a top view of the portable compression device of FIG. 39.
Figures 43, 44, 45, 46:
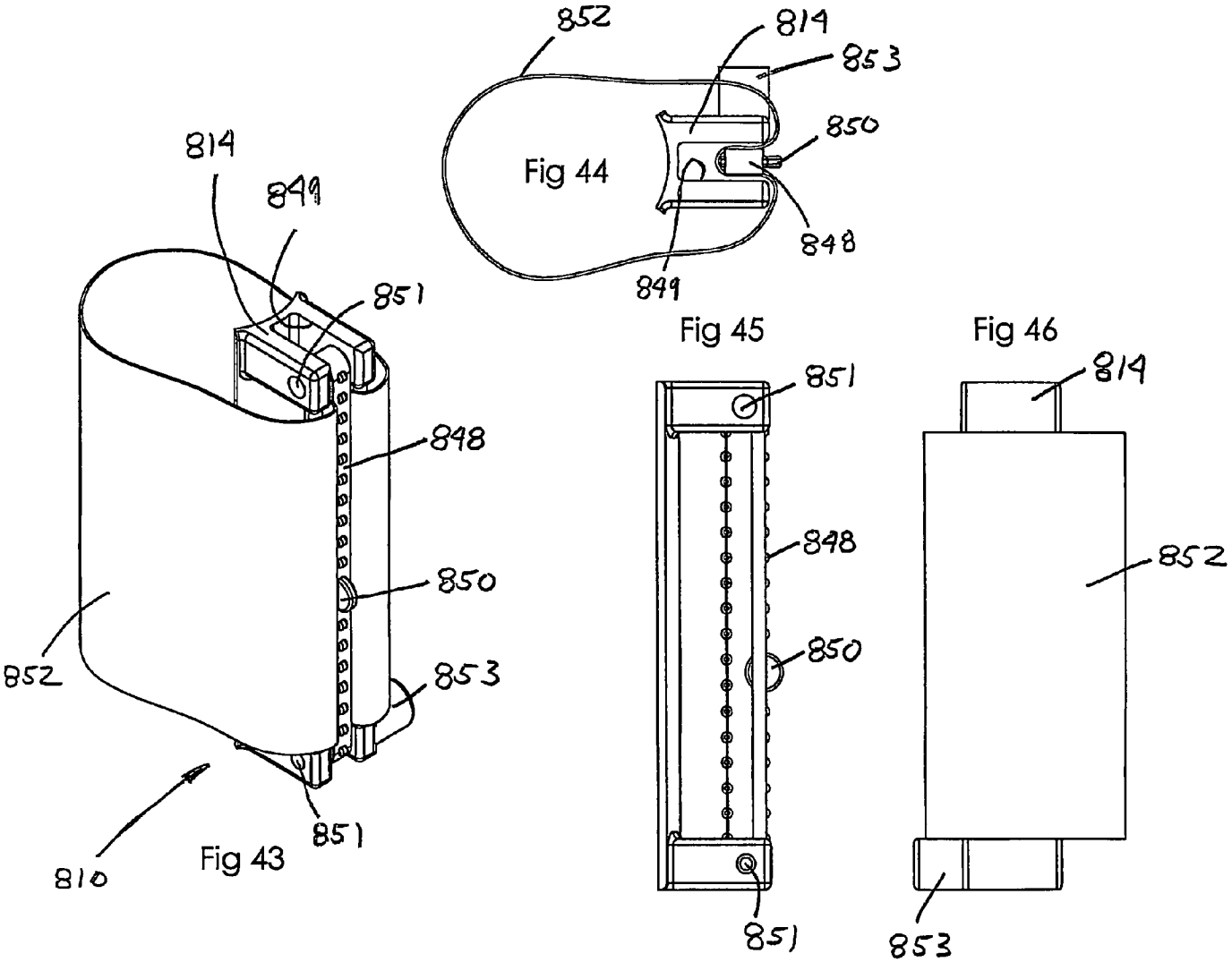
FIG. 43 is a perspective view of another portable compression device in accordance with one non-limiting embodiment of the present invention.
FIG. 44 is a top view of the portable compression device of FIG. 44.
FIG. 45 is a side view of the portable compression device of FIG. 44 without the resilient sleeve attached.
FIG. 46 is rear view of the portable compression device of FIG. 44.
Figure 49:
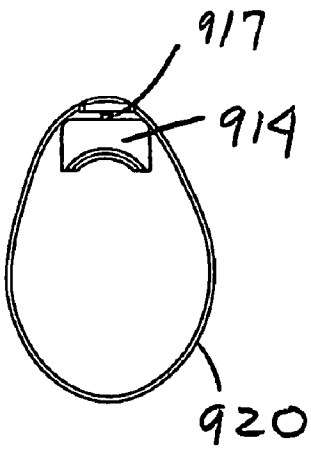
FIG. 49 is a top view of the portable compression device of FIG. 47.
Figure 51:
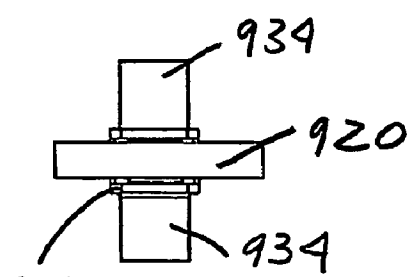
FIG. 51 is an elevation view of the portable compression device of FIG. 47.
Figure 50:
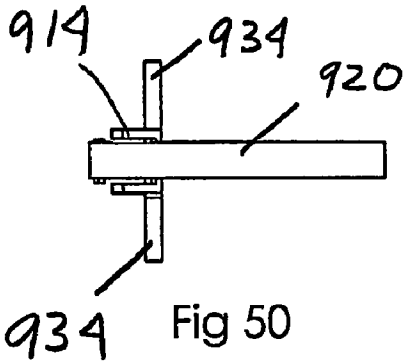
FIG. 50 is a side view of the portable compression device of FIG. 47.
Figure 47:
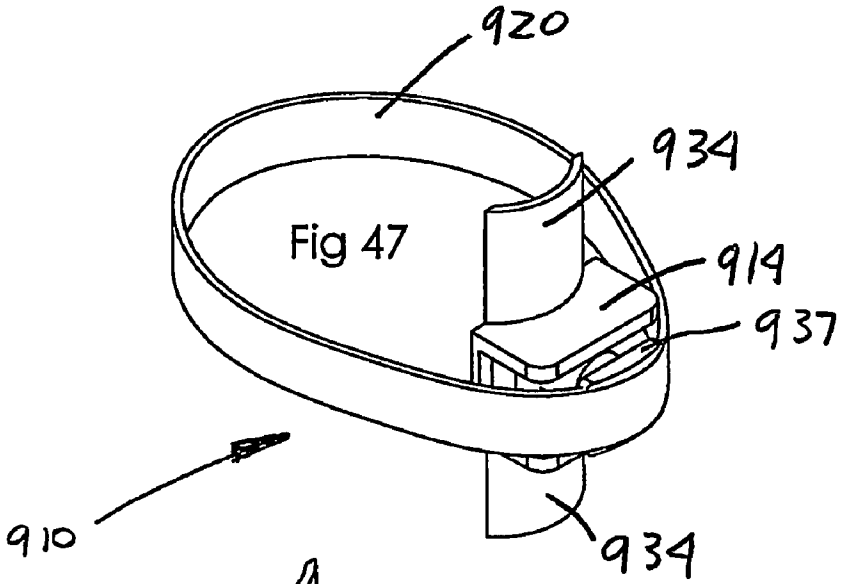
FIG. 47 is a perspective view of a portable compression device in accordance with one non-limiting embodiment of the present invention.
Figure 48:
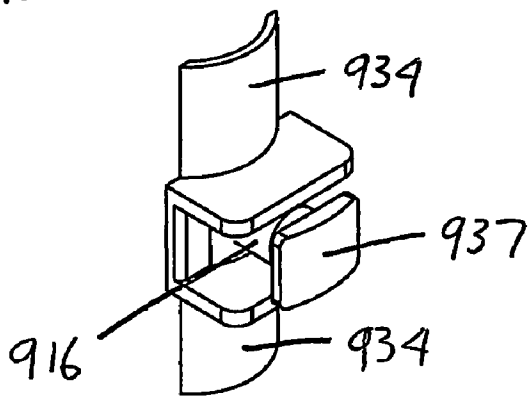
FIG. 48 is a perspective view of a portion of the portable compression device of FIG. 47 without a flexible elongate member attached.
Figures 52, 53, 54, 55:
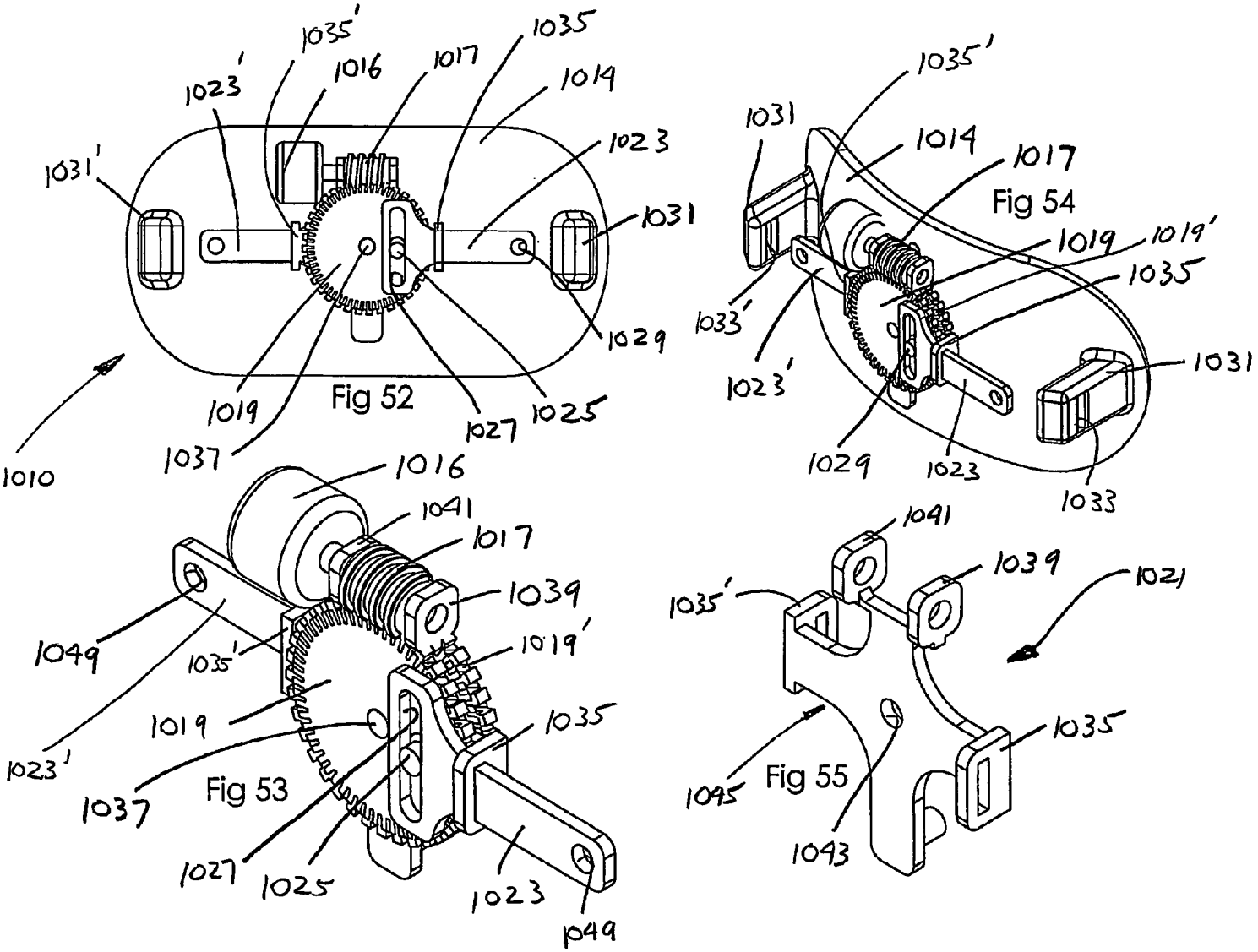
FIG. 52 is an elevation view of a portion of a portable compression device in accordance with one non-limiting embodiment of the present invention.
FIG. 53 is a perspective view of the portion of the portable compression device of FIG. 52 without the frame illustrated.
FIG. 54 is a perspective view of the portable compression device of FIG. 52.
FIG. 55 is a perspective view of the portable compression device of FIG. 52 illustrating the sub-frame.
Figures 56, 57, 58, 59:
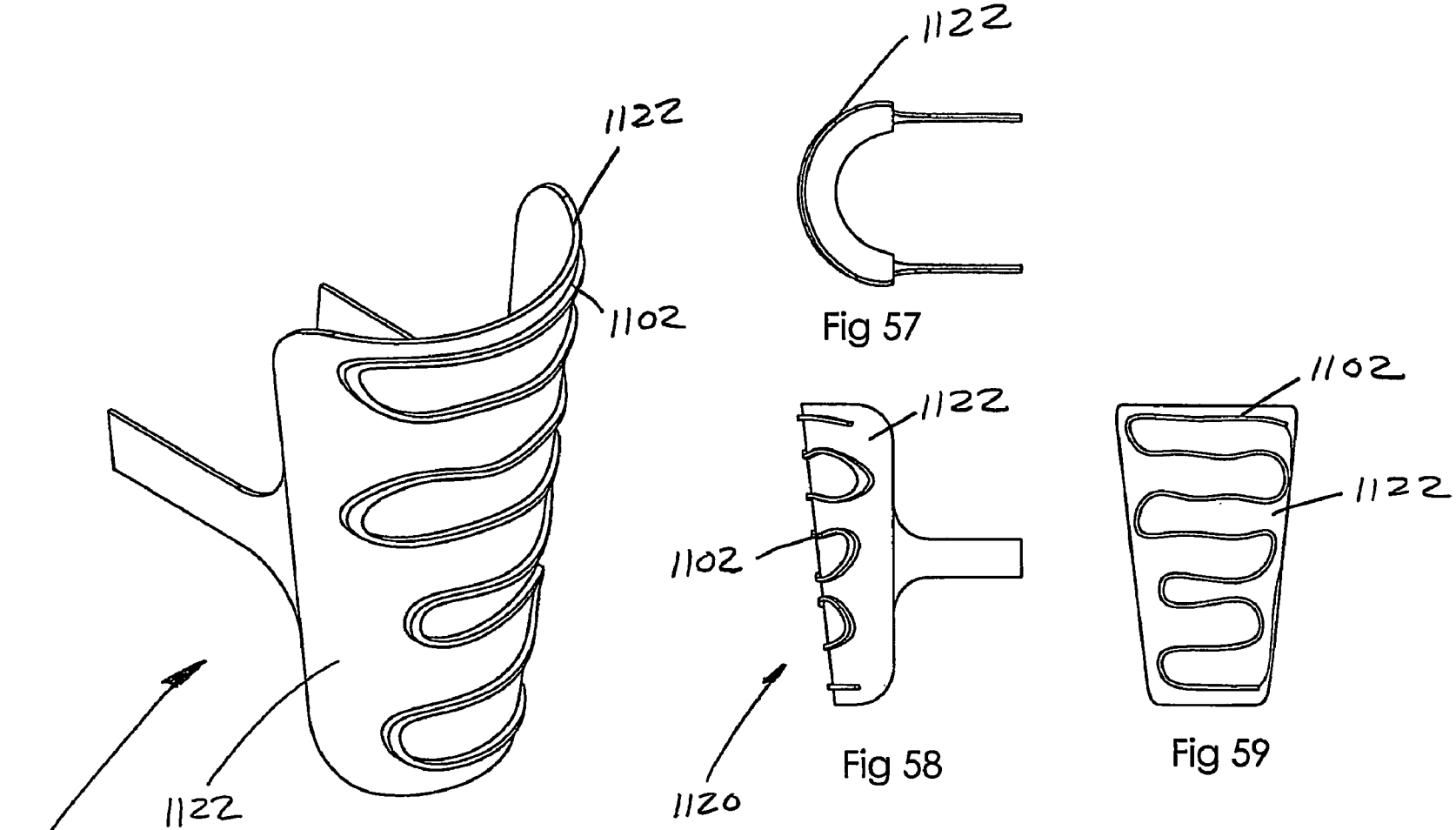
FIG. 56 is a perspective view of an arcuate strap including a conductive element in accordance with one non-limiting embodiment of the present invention.
FIG. 57 is a top view of the arcuate strap of FIG. 56.
FIG. 58 is a side view of the arcuate strap of FIG. 56.
FIG. 59 is an elevation view of the arcuate strap of FIG. 56.
Figure 61:
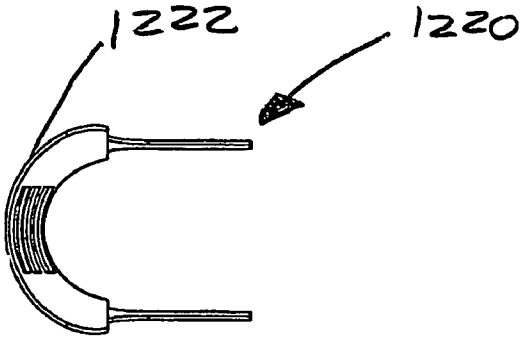
FIG. 61 is a top view of the arcuate strap of FIG. 60.
Figure 62:
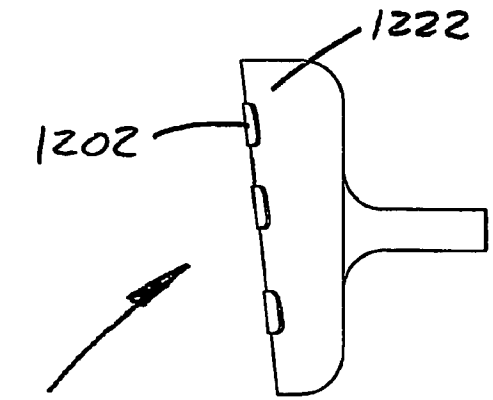
FIG. 62 is a side view of the arcuate strap of FIG. 60.
Figure 63:
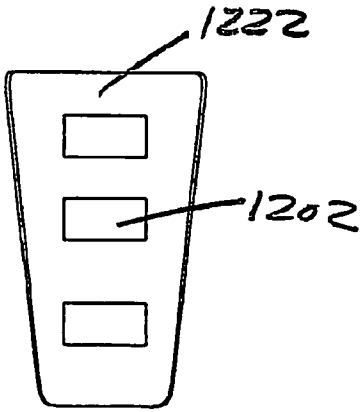
FIG. 63 is an elevation view of the arcuate strap of FIG. 60.
Figure 60:
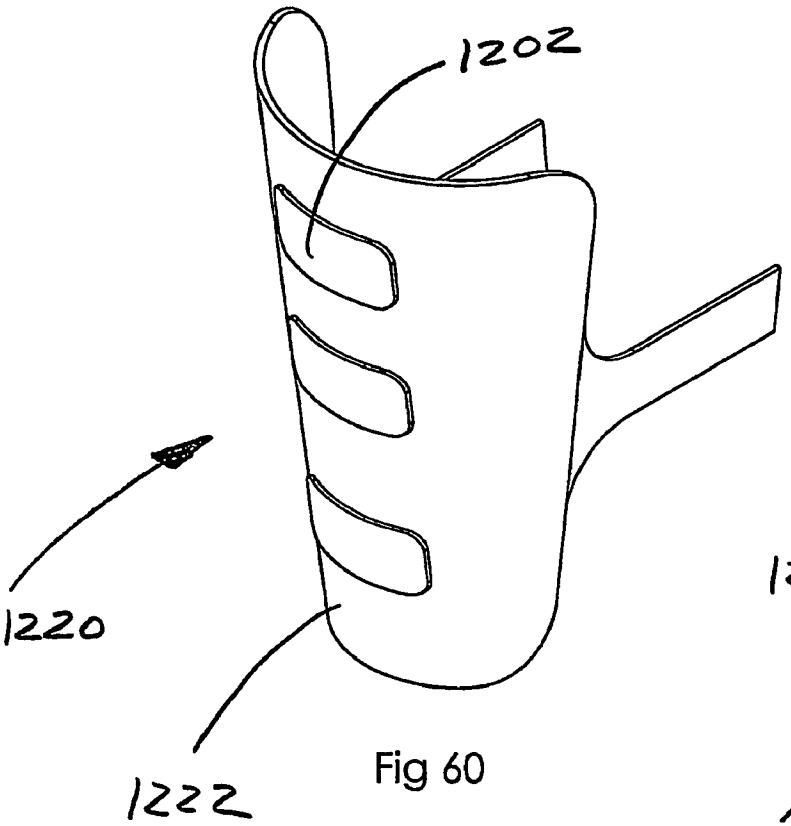
FIG. 60 is a perspective view of another arcuate strap including a plurality of one of ultrasound or vibratory transducers in accordance with one non-limiting embodiment of the present invention.
Figure 65:
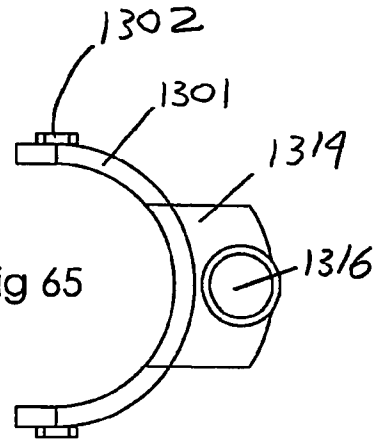
FIG. 65 is a top view of the portable compression device of FIG. 64.
Figure 67:
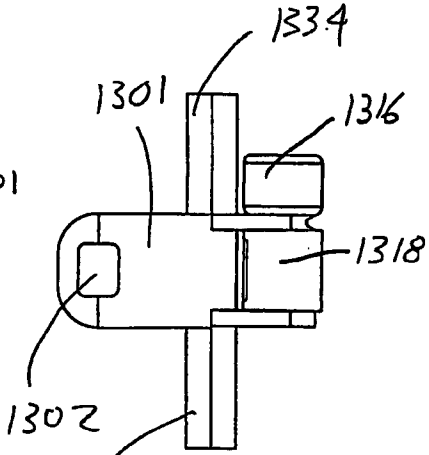
FIG. 67 is a side view of the portable compression device of FIG. 64.
Figure 66:
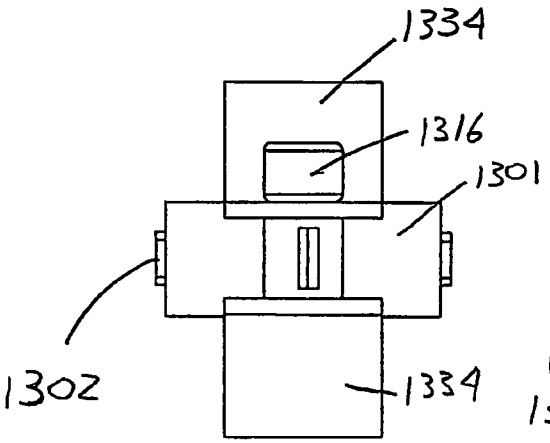
FIG. 66 is an elevation view of the portable compression device of FIG. 64.
Figure 64:
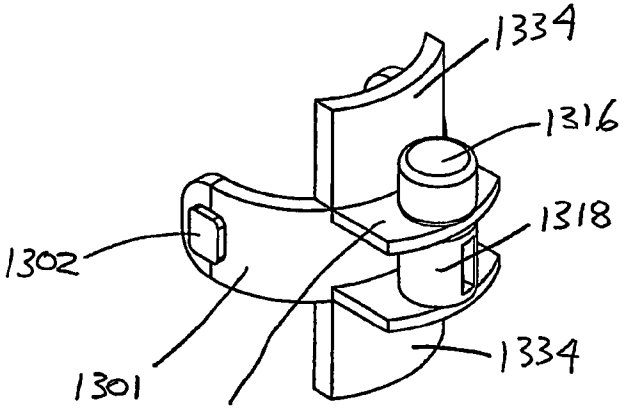
FIG. 64 is a perspective view of a portable compression device including an arcuate frame extension supporting at least one of ultrasound or vibratory transducers.

In various embodiments, referring to FIGS. 36-38, a strap 620 can include an arcuate portion 622 and one or more extension portions 624. In at least one embodiment, strap 620 can include a distal-most strap 640, one or more middle straps 642 and a proximal-most strap 644. In various embodiments, the extension portions 624 can be connected to a drum, and the drum can be operably engaged with the actuator by a drive shaft. In at least one embodiment, when the actuator is powered, it can rotate the drive shaft, and in turn the drum, to thereby apply a compressive force to the arcuate portion 622 and a portion of the limb of the patient. In at least one embodiment, a compressive force of a greater magnitude can be applied to the distal-most strap 640, while a compressive force of a lesser magnitude can be applied to the middle strap 642, and an even lesser force can be applied to the proximal-most strap 644, for example. The differing compressive forces applied to the various straps 640, 642, and 644 can be a result of the length of each strap, for example. In other various embodiments, the compressive force of the greater magnitude could be applied to the proximal-most strap 644 or the middle strap(s) 642 and the compressive force of the lesser magnitude could be applied to the distal-most strap 640. By applying a different compressive force to each of the straps 640, 642, and 644, blood flow can be promoted either toward or away from the patient's heart.

In various embodiments, referring to FIGS. 39-42, a PCD 710 can include a frame 714, a drum 718, an actuator 716, and first and second projections 734. Similar to various embodiments of PCDs discussed above, the actuator 716 can include a drive shaft and the drum 718 can include an aperture configured to accept the drive shaft. In such a fashion, the actuator 716 can rotate the drive shaft to thereby move and/or rotate the drum 718 in a clockwise or a counter-clockwise direction, for example. In various embodiments, a pin 721 can be fixed to the frame 714 and can be configured to be attached to a first end 723 of the strap 720, such that the first end of the strap can be allowed only very limited movement during compression of a limb. In such an embodiment, the strap 720 can be configured to at least partially surround a portion of the limb of a patient and can include a second end 725 configured to be engaged with a portion of the drum 718. In various embodiments, when the actuator 716 rotates the drive shaft and the drum 718, a portion of the strap 720 can be coiled around a portion of the drum to thereby shorten the strap and apply a compressive force to the portion of the patient's limb. Similarly, when the actuator 716 rotates the drum 718 in the opposite direction, the strap can be uncoiled from the drum 718 to lengthen the strap and thereby release the compressive forced being applied to the portion of the patient's limb, for example. Although, only one PCD 710 is illustrated in FIGS. 39-42, those of ordinary skill in the art will recognize that any number of PCDs can be used on the limb.

In various embodiments, referring to FIGS. 43-46, a PCD 810 can include a resilient sleeve 852 and a frame 814 having a channel 849 defined therein. In at least one embodiment, the resilient sleeve 852 can be configured to be positioned at least partially around a portion of a limb of a patient and at least partially surround the frame 814. In various embodiments, a strap or chain 848 can be at least partially positioned within the channel 849 and can be wrapped around two or more gears, wheels, and/or pins 851. In such an embodiment, an actuator 853 can be configured to drive at least one of the gears, wheels, and/or pins 851 to thereby cause the chain 848 to rotate at least partially within the channel 849 and about the gears, wheels, and/or pins 851 owing to the tension on the chain 848. In various embodiments, the PCD 810 can be similar in operation to the PCD 410 described above and illustrated in FIGS. 28-31, however, in this embodiment, a portion of the resilient sleeve 452 can be positioned within the channel 849 and can be contacted by a cam 850 attached to the chain 848 within the channel, for example. In such a fashion, a portion of the resilient sleeve 852 substantially opposite from the cam 850 can be tensioned owing to the force applied to the resilient sleeve by the cam such that a compressive force can be applied to a portion of the limb within the resilient sleeve 852. In such an embodiment, as discussed above with respect to cam 450 of FIG. 28*a*, the size and profile of the cams 850 can be varied to modify the compressive force applied to a portion of the patient's limb, for example. In various embodiments, the PCD 810 and cam 850 can be used to apply a compressive force to a portion of the limb within the resilient sleeve from a distal-most portion to a proximal-most portion to promote blood flow towards a patient's heart. As described above, the direction of the rotation of the cam 850 on the chain 848 can be reversed to thereby compress the portion of the limb within the resilient sleeve from the proximal-most portion to the distal-most portion, for example.

In various embodiments, referring to FIGS. 47-51, a PCD 910 can include a frame 914, a linear actuator 916 comprising a piston 917, first and second projections 934, and a strap 920. In at least one embodiment, the linear actuator 916 can be positioned on and/or attached to a portion of the frame 914. In such an embodiment, the piston 917 of the linear actuator 916 can include a plate portion 937 positioned on a distal end thereof, wherein the piston can be configured to be extended from the frame and be retracted into a housing of the linear actuator 916. In various embodiments, the plate portion 937 can be extended from the frame by the piston 917 to contact and push a portion of the strap 920 away from the frame 914 such that the length of the strap positioned around a portion of a limb can be shortened thereby applying a compressive force to the limb. In at least one embodiment, to release the tension on the strap 920, the piston 917 can be retracted into the housing of the linear actuator 916 such that the length of the strap positioned around the portion of the limb can be lengthened thereby reducing, or eliminating, the application of the compressive force to the portion of the limb. In various embodiments, the linear actuator 916 can include any suitable type of linear actuator, for example.

In various embodiments, referring to FIGS. 52-55, a PCD 1010 can include a frame 1014, an actuator 1016, a worm 1017, at least one worm gear 1019, a sub-frame 1021 (see, e.g., FIG. 55), and at least one crank 1023. In at least one embodiment, the worm 1017 can be positioned intermediate stops 1039 and 1041 of the sub-frame 1021. In various embodiments, a drive shaft (not illustrated) of the actuator 1016 can be operably engaged with the worm 1017, such that the actuator can rotate the worm in a clockwise and/or a counter-clockwise direction while the worm remains positioned intermediate stops 1039 and 1041. In at least one embodiment, two worm gears 1019 and 1019' can be attached to the sub-frame 1021 using a pin 1037, wherein the pin can be configured to be engaged with an aperture 1043 in the sub-frame 1021. In such an embodiment, the two worm gears 1019 and 1019' can both rotate about the pin 1037 when driven by the worm 1017. In various embodiments, the worm 1017 can include a threaded portion and the worm gears 1019 and 1019' can each include teeth configured to be engaged with the threaded portion of the worm 1017 such that such that the worm can drive the worm gears and cause them to rotate, for example. In various embodiments, one worm gear 1019 can be rotated in a direction opposite that of the other worm gear 1019' or both worm gears can be rotated in the same direction, for example. In other various embodiments, the PCD 1010 can include only one crank 1023 and one worm gear 1019 such that a first end of a strap (not illustrated) can be fixed to the frame, while the second end of the strap can be attached to the crank such that the a portion of the strap can be reciprocated by the worm gear and the crank, for example.

In various embodiments, still referring to FIGS. 52-55, the sub-frame 1021 can further include at least one crank receiving member 1035. In other various embodiments, where two cranks 1023 and 1023' and two worm gears 1019 and 1019' are used, two crank receiving members 1035 and 1035' can be provided and can each extend in opposite directions from a body 1045 of the sub-frame 1021, for example. In at least one embodiment, the crank receiving member(s) 1035 and 1035' can extend in a direction perpendicular to, or substantially perpendicular to, the body 1045 of the sub-frame system 1021, for example. In at least such an embodiment, the crank receiving members 1035 and 1035' can each be configured to slidably receive an elongate portion of the cranks 1023 and 1023' and limit the movement thereof to a generally linear and/or horizontal direction such that the rotational motion of the worm gears can be translated into linear motion of the cranks owing to pins 1025 extending from the worm gears and engaging slots 1027 and 1027' in the cranks 1023 and 1023'. In various embodiments, each pin 1025 can be configured to slide and/or act within each slot 1027 in each crank 1023 and 1023' as the worm gears are driven by the worm, for example.

In various embodiments, the PCD 1010 can further include a strap having two ends, wherein a first end can be attached to one to the cranks 1023 and a second end can be attached to another crank 1023', for example. In such an embodiment, the ends can be attached to the cranks proximate to, or within apertures 1049, for example, such that the length of the strap at least partially surrounding a portion of the limb of a patient can be shortened to apply a compressive force to the portion of the limb and lengthened to reduce and/or eliminate the compressive forced being applied to the limb. In at least one embodiment, the strap can be threaded through slots 1033 and 1033' in projections 1031 and 1031' which can extend from the frame 1014 to prevent, or at least inhibit, the straps from becoming twisted and/or tangled during the compressional movement and while attached to the cranks 1023. In various embodiments, one worm gear 1019' and one crank 1023' can be eliminated and a first end of the strap can be fixedly mounted to a portion of the frame 1014, for example. In such an embodiment, the other worm gear 1019 can motivate the other crank 1023 such that a tensile force can be applied to the strap to thereby apply a compressive force to a portion of the limb.

In various embodiments, referring to FIGS. 52-55, the actuator 1016 can provide a rotary torque to the worm 1017, wherein the threads of the worm can be engaged with the teeth of the worm gears 1019 and 1019'as described above. In such an embodiment, the rotation of the worm gears 1019 and 1019' can be translated into a linear motion of each the cranks 1023 and 1023', which motion may be limited to only one degree of freedom, or substantially one degree of freedom, by the crank receiving members 1035 and 1035'. In various embodiments, the reciprocal linear motion of the cranks 1023 and 1023' can occur owing to pins 1025 attached to and/or integral with and extending from each of the worm gears 1019 and 1019'. In such an embodiment, the pins can be configured to slidably engage the slot 1027 in the cranks 1023 and 1023'. In various embodiments, the continuous drive of the actuator 1016 can result in continuous rotation of the worm 1017 and, in-turn, continuous drive of the worm gears 1019 and 1019'. In at least one embodiment, the rotation of the worm gears 1019 and 1019' can result in reciprocal linear motion of the cranks 1023 and 1023', to thereby shorten and lengthen a portion of the strap surrounding a portion of a patient's limb to thereby compress and relax the compression on the portion of the limb, for example. In various embodiments, the PCD 1010 can be used as a single unit on a limb. In other various embodiments, multiple PCDs 1010 can be used on the limb in series, for example. In such embodiments, the multiple PCDs can sequentially compress the limb and/or can randomly compress the limb, for example.

In various embodiments, any of the PCDs discussed herein can include various additional mechanisms and/or components configured to provide at least one of heat, vibration, muscle stimulation, ultrasound therapy, and/or other suitable therapies to a portion of the limb of a patient or mammal before, during, and/or after compression by the PCD. In at least one embodiment, the mechanisms can be included in and/or on a portion of a PCD, such as on or in the straps and/or attached to or formed with the frame of the PCD, for example. In other various embodiments, the mechanisms can be included on any other suitable portion of the PCD. The various mechanisms can function as separate therapeutic modalities and/or can function in conjunction with the compression mechanisms of the various PCDs discussed herein. In other various embodiments, the various mechanisms (i.e., heat, vibration, muscle stimulation, and ultrasound therapy etc.) can all be included in a PCD and can function together with or without the compression provided by the PCD.

In various embodiments, a heat generating element (not illustrated), such as a power source, one or more chemical reactants, and/or a thermal sink, for example, can be mounted on and/or integral with a frame of any of the various PCDs described above. In other various embodiments, the heat generating element can be mounted on a strap and/or can be integral with the strap, for example. In at least one embodiment, referring to FIGS. 56-59, at least one conductive element 1102, which can comprise an electrical conductor, a tubular bladder system, and/or a thermal conductor, for example, can be run through and/or run along an arcuate portion 1122 of a strap 1120 and/or a limb engaging portion of the PCD, for example. In various embodiments, the conductive element can be included in a resilient sleeve and/or a boot, for example. In other various embodiments, the conductive element can be included in a flexible elongate member, such as strap 20, for example. In at least one embodiment, more than one conductive element can be provided on any of the various straps, for example. In various embodiments, the conductive element 1102 can be comprised of a resistive electrical conducting wire embedded at least partially between electrical insulating sheets having good thermal conducting properties. In at least one embodiment, the resistance in the wire can cause heat to be provided to the conductive element 1102, while the electrical insulating sheets can prevent the patient from being disturbed by the electric current running through the conductive element. In such an embodiment, the thermal conducting properties of the insulating sheets can help distribute the heat from the resistive wire to the outer thermally conductive/electrically insulative sheets. The mechanism for which heat can promote angiogenesis in the patient can be two fold. First, heat can cause a local effect where the increase in heat can produce an increase in blood flow to and/or from a region of the limb. Secondly, the increase in localized blood flow can increase the product of growth factors to promote angiogenesis, for example.

In various embodiments, an electronic vibration generating element (not illustrated) and/or an ultrasound generating unit (not illustrated) can be included on a PCD and may be engaged with, positioned on, and/or integral with the frame or other portion of the PCD, such as the strap, for example. In at least one embodiment, referring to FIGS. 60-63, the electronic vibration generating element can be used in conjunction with at least one transducer 1202 which can be configured to produce one or more vibration waves that can be used to mechanically massage a portion of a limb of a patient and/or stimulate muscles in the limb, for example. In various embodiments, the at least one transducer 1202 can be positioned on an arcuate portion 1222 of a strap 1220, for example. In other various embodiments, the at least one transducer can be positioned on a strap, such as strap 20 of FIG. 1, and/or positioned on and/or integral with the frame, for example. In at least one embodiment, the electronic vibration generating element can produce a vibration through the use of an actuator (e.g., an electric motor) with an eccentric mass attached to the shaft of the motor. In at least such an embodiment, with the eccentric mass attached to the motor, as the shaft rotates, the shaft can induce an oscillatory force (i.e., vibration) on the eccentric mass of the motor due to the misalignment between the axis of rotation of the motor shaft, and the center of mass of the attached eccentric mass.

Mechanical stimulation, in the form of vibration, for example, can have a proangiogenic affect on soft tissue. In at least one embodiment, the vibratory mechanism (i.e., electronic vibration generating element and transducer) can deliver either a continuous or pulsating vibration to a portion of the limb in conjunction with the compression provided by one of the various PCDs discussed herein to further promote blood flow toward the heart of a patient, for example, such that the patient can receive therapeutic proangiogenic benefits. Primary stimulus for angiogenesis can be considered to be a relative mismatch between supply and demand for substrate of the host tissue. In mammals, this can lead to an expanded capillary bed in response to either increased anabolic drive (growth), catabolic activity (exercise), and/or oxygen deficit (hypoxia). On a cellular level, these proangiogenic findings can be seen when mechanical factors such as increased blood flow and capillary shear stress, acting as a luminal signal, are important in promoting capillary growth. The pattern of capillary supply in skeletal muscle has been demonstrated to be influenced by mechanical stimuli imposed by a sustained increase in muscle activity, or by chronic muscle overload, for example. The same concept of supply and demand governs the stimulation of capillary supply proliferation seen when a pulsetile electronic stimulus is applied to a muscle causing contraction with subsequent relaxation as the pulsetile electronic stimulus is withdrawn. The added work of the muscle produces a localized hypoxic environment which recruits growth factors on a cellular level to stimulate microvasculature growth.

Although many factors including muscle fiber size, girth, and relative functional abilities (e.g., more oxidative versed more glycolytic regions) seem to be involved with the angiogenesis ability of muscle, common pathways in the process can include a stimulated increase in luminal shear stress, which can be linked to increased capillary expression of a vascular endothelial growth factor (VEGF), a well described proangiogenic growth factor. This mechanical process can also be achieved with external compression of muscle fibers to increase the intraluminal pressure of a vessel both in the vibratory as well as the intermittent muscle stimulation causing this well described effect. Mechanical stimuli for angiogenesis is therefore directly or indirectly influenced by the local environment to recruit capillary growth, an important part of wound healing in particular to the lower extremities, which often fester skin breakdowns and frank ulcerations secondary to peripheral vascular disease (PVD) and poor microcirculation.

The incorporation of a continual or pulsatile vibratory element and or intermittent muscle stimulator to the various PCDs offers simultaneous DVT prophylaxis in high risk vasculopath populations along with proangiogenic microcirculation benefits, important in wound healing, as well as wound prevention. Vibration and muscle simulation treatment therapies are generally described in Adair T H, Gay W J, Mantani J-O (1990). Growth Regulation of the Vascular System: Evidence for a Metabolic Hypothesis. *Am J Physiol* 259, R393-404; Hudlická O (1998). Is Physiological Angiogenesis in Skeletal Muscle Regulated by Changes in Microcirculation? *Microcirculation* 5, 7-23; Hudlická O, Dodd L, Renkin E M, Gray S D (1982). Early Changes in Fiber Profile and Capillary Density in Long-term Stimulated Muscles. *Am J Physiol* 243, H528-535; Egginton S, Hudlická O, Brown M D, Walter H, Weiss J B, Bate A (1998). Capillary Growth in Relation to Blood Flow and Performance in Overloaded Rat Skeletal Muscle. *J Appl Physiol* 85, 2025-2032; Deveci D, Marshall J M, Egginton S (2001). Relationship Between Capillary Angiogenesis, Fibre Type and Fibre Size in Chronic Systemic Hypoxia. *Am J Phyiol Heart Circ Physiol* 281, H241-255; Dawson J M, Tyler K R, Hudlická O (1987). A Comparison of the Microcirculation in Rat Fast Glycolytic and Slow Oxidative Muscles at Rest and During Contractions. *Microvasc Res* 33, 167-182; Milkiewicz M, Brown M D, Egginton S, Hudlická O (2001). Shear Modulation of Angiogenesis and VEGF in Skeletal Muscles In Vivo. *Microcirculation* 8, 229-241; and Badr I, Brown M D, Egginton S, Hudlická O (2003). Differences in Local Environment Determine the Site of Physiological Angiogenesis in Rat Skeletal Muscle. *Ex Physiology* 88, 565-568, which are all hereby incorporated by reference in their entireties.

Further to the above, in various embodiments, still referring to FIGS. 60-63, the ultrasound generator unit can be engaged with and/or positioned on the frame of one of the various PCDs discussed herein with at least one transducer 1202 distributed through the arcuate portion of the strap 1220. As discussed above, with reference to the electronic vibration generating element, the ultrasound generator unit, and transducer can be positioned at other locations on various PCDs and/or straps. In at least one embodiment, ultrasound waves can be transmitted from the ultrasound generator unit to the transducers on the arcuate portion 1222 of the strap 1220 such that the ultrasound waves can be applied to a portion of a limb of a patient.

In various embodiments, these therapeutic ultrasound techniques can comprise generating an inaudible high frequency mechanical vibration using a piezo-electric crystal. In at least one embodiment, the inaudible high frequency mechanical vibration can then be transmitted to and expressed by the transducer 1202. In such an embodiment, the therapeutic ultrasound frequencies can be 1-3 MHz, for example, whereas low frequency waves (i.e., 1 MHz) can have greater depth (typically from 3-5 cm from the contact surface of the transducer on the limb) of penetration but can be less focused. In other various embodiment, higher frequency ultrasounds (i.e., 3 MHz) can have less penetration into soft tissue (typically 1-2 cm from the contact surface of the transducer on the limb) and can be more focused.

In various embodiments, the characteristics of the soft tissue in a limb can also influence the acoustic penetration of the ultrasound waves. In at least one embodiment, tissue with higher water content (e.g., fat) can have a lower absorption (and therefore higher penetration) of ultrasound, and tissue with less water content (e.g., skeletal muscle, bone) can have higher absorption (with less penetration).

In vitro physiologic effects of ultrasound therapies can include thermal and non-thermal effects on tissue. Local thermal effects of ultrasound on tissue can include an increase in blood flow, a reduction of muscle spasm, an increased extensibility of collagen fibers and proinflammatory response (tissue healing). Thermal effects can occur with tissue temperatures of 40-45° C. for at least five minutes, for example. The effects can all be proangiogenic effects and can all contribute to prevention of peripheral vascular disease. Non-thermal effects of ultrasound can include cavitation (gas-filled bubbles within tissue expand and compress when subjected to ultrasound waves) and acoustic microstreaming (unidirectional movement of fluids along a cell membrane) which too can have a proinflammatory effect. The non-thermal effects of ultrasound (cavitation and microstreaming) have been demonstrated in vitro including stimulation of fibroblast repair and collagen synthesis, tissue regeneration, and bone healing. Various ultrasound therapies are described in further detail in Prentice W E. Therapeutic Modalities in Sports Medicine, 3rd edition. St Louis: Mosby, 1994; Wells P N T, Biomedical Ultrasonics. London: Academic press, 1977; Williams A R. Production and Transmission of Ultrasound. Physiotherapy 1987;73:116-20; Dyson M, Suckling J. Stimulation of Tissue Repair by Ultrasound: A Survey of the Mechanism Involved. Physiotherapy 1978;64:105-8; Webster D F, Harvey W, Dyson M, Pond J B, The Role of Ultrasound-induced Cavitation in the "In-vitro" Stimulation of Collagen Synthesis in Human Fibroblasts. Ultrasonics 1980; 18:33-7; Dyson M, Luke D A. Induction of Mast Cell Degranulation in Skin by Ultrasound. IEEE Trans Ultrasonics Ferroelectronics Frequency Control 1986;UFFC-33:194; Webster D F. The Effect of Ultrasound on Wound Healing. PhD Thesis. London, University of London, 1980; By N N, McKenzie A L, West J M et al. Low Dose Ultrasound Effect on Wound Healing: A Controlled Study With Yucatan Pigs. Arch Phys Med Rehab 1992;73:656-64; Pilla A A A, Figueiredo M, Nasser P et al. Non-invasive Low Intensity Pulsed Ultrasound: A Potent Accelerator of Bone Repair. Proceedings, 36th Annual Meeting, Orthopedics Research Society, New Orleans, 1990, which are all hereby incorporated by reference herein in their entireties.

In various embodiments, referring to FIGS. 64-67, at least one transducer 1302 for providing vibrational energy and/or ultrasound waves to a portion of a limb can be included on an arcuate portion 1301, or other suitable portion, of a frame 1314, for example. In at least one embodiment, the frame can include an actuator 1316, a drum 1318, and first and second projections 1334, for example. In such an embodiment, the frame 1314 can also include the electronic vibration generating element and/or an ultrasound generating unit for producing vibration or ultrasound waves through the transducer 1302.

In various embodiments, referring to FIGS. 68-71, a PCD 1410 can include a torsion spring 1401, a frame 1414, a drum 1418, and an actuator 1416. In such an embodiment, although not illustrated, a strap can be attached to the drum and/or threaded through a slot 1424 in the drum, as discussed above in reference to other various embodiments. In at least one embodiment, the torsion spring 1401 can include a first pin 1403 extending downwardly therefrom, wherein the first pin can be configured to engage an aperture in the drum to allow the torsion spring to rotate the drum. In at least one embodiment, the torsion spring 1401 can further include a second pin 1405 extending upwardly therefrom, wherein the second pin can be configured to engage an aperture in the frame 1414, such that rotation of the drum will increase or decrease energy in the spring depending on the direction of rotation. In such an embodiment, because the actuator 1416 is engaged with the drum through a drive shaft (not illustrated), the actuator can move the torsion spring between a first biased position and a second unbiased position by rotating the drum. In at least one embodiment, the torsion spring can be positioned intermediate the drum 1418 and the actuator 1416.

In operation, while the strap in not at least partially coiled around the drum, the actuator can hold the torsion spring 1401 in the first biased position, and then release tension on the drum to allow the torsion spring 1401 to rotate the drum into the second unbiased position. In such as fashion, owing to the first pin's engagement with the drum, the second pin's engagement with the aperture in the frame, and the torsion spring's need to achieve the lowest energy state, (i.e., second unbiased position), the drum can be rotated in a clockwise or counter-clockwise direction thereby coiling at least a portion of the strap around the drum. Such coiling can reduce the length of the strap around at least a portion of a limb of a patient and thereby apply the compressive force to the limb, for example. In various embodiments, to release the compressive force being applied to the limb by the strap, the actuator 1416 can rotate the drum (and thereby the torsion spring) back into the first biased position, thereby allowing the portion of the strap to be uncoiled from the drum and reduce, or extinguish, the compressive force being applied to the limb by the strap. In at least one embodiment, the torsion spring 1401 can be used as a fail-safe mechanism in the sense that the torsion spring can only apply a prescribed tensile force to the strap when moving from the first biased position to the second unbiased position, thereby preventing, or at least inhibit, over-tightening of the strap, for example.

While various embodiments of the PCD have been described with reference to the treatment of VTE, these various embodiments of the PCD can also be used to treat many other conditions. For example, the PCD can be used for massage therapy, muscle aches, and/or therapy for lymph edema. Further, the various embodiments of the PCD can also be used to treat any other condition, wherein the PCD's use would be beneficial to the patient.

We claim:

1. A portable limb compression assembly configured to promote blood flow in a mammal, the assembly comprising:

a frame;

a first drum configured to be engaged with a first portion of the frame;

a first actuator configured to be operably engaged with the first drum, wherein the first actuator is configured to move the first drum between a first position and a second position;

a first flexible elongate member configured to be engaged with a portion of the first drum, wherein the first flexible elongate member is configured to at least partially surround at least a portion of a limb of the mammal, wherein the first flexible elongate member has a first perimeter around the portion of the limb when the first drum is in the first position, wherein the first flexible elongate member has a second perimeter around the portion of the limb when the first drum is in the second position, and wherein the first perimeter is larger than the second perimeter such that a compressive force can be applied to the portion of the limb when the first drum in is the second position;

a second drum configured to be engaged with a second portion of the frame;

a second actuator configured to be operably engaged with the second drum, wherein the second actuator is configured to move the second drum between a first position and a second position; and a second flexible elongate member configured to be engaged with a portion of the second drum, wherein the second flexible elongate member is configured to at least partially surround at least another portion of a limb of the mammal, wherein the second flexible elongate member has a first perimeter around the other portion of the limb when the second drum is in the first position, wherein the second flexible elongate member has a second perimeter around the other portion of the limb when the second drum is in the second position, and wherein the first perimeter is larger than the second perimeter such that a compressive force can be applied to the other portion of the limb when the second drum in is the second position.

2. The assembly of claim 1, wherein the first portion of the frame includes a first aperture configured to slidably receive a portion of the first flexible elongate member therethrough at least when the first actuator moves the first drum between the first position and the second position and wherein the second portion of the frame includes a second aperture configured to slidably receive a portion of the second flexible elongate member therethrough at least when the second actuator moves the second drum between the first position and the second position.

3. The assembly of claim 1, wherein the first flexible elongate member includes:

a first portion having a first length; and a second portion having a second length, wherein the second length is shorter than the first length such that the second portion can apply a greater compressive force to the portion of the limb than the first portion when the drum is moved between the first position and the second position.

4. The assembly of claim 1, wherein the first actuator further comprises a drive shaft extending therefrom, wherein the first drum further comprises an aperture configured to receive the drive shaft, and wherein the drive shaft is configured to be operably engaged with the aperture such that the actuator can rotate the first drum between the first position and the second position.

5. The assembly of claim 1, wherein the first drum further comprises a slot, and wherein the first flexible elongate member is configured to be engaged with the slot such that the first drum can at least partially coil the first flexible elongate member therearound at least when the first drum is moved between the first position and the second position.

6. The assembly of claim 1, wherein the first flexible elongate member includes a first end and second end, wherein the first end is configured to be fixedly attached to a portion of the frame, and wherein the second end is configured to be engaged with a portion of the drum.

7. The assembly of claim 1, wherein each of the first and second actuators are configured to be actuated one of sequentially and randomly.

8. The assembly of claim 1, wherein the frame is a boot or a resilient sleeve, wherein the boot or the resilient sleeve is configured to at least partially surround the portion of the limb of the mammal, and wherein at least a portion of the assembly is configured to be at least partially positioned on the boot or the resilient sleeve.

9. The assembly of claim 1, wherein the frame is a resilient sleeve and further comprises a first projection and a second projection, wherein the first and second projections are configured to act against one of the portion of the limb and the resilient sleeve, and wherein the first and second projections are configured to distribute a force applied to the frame over an area of the portion of the limb when at least one of the first or second drums is in the second position.

10. The assembly of claim 1 wherein the frame comprises a rigid member.

11. The assembly of claim 1 wherein the frame comprises a connection member, wherein the first portion of the frame comprises a first member, wherein the second portion of the frame comprises a second member formed separately from the first member, and wherein the connection member at least partially engages the first member and the second member.

* * * * *